US007168998B1

(12) United States Patent
Jones et al.

(10) Patent No.: US 7,168,998 B1
(45) Date of Patent: Jan. 30, 2007

(54) PERSONAL WATERCRAFT FORCED AIR INDUCTION SYSTEM

(75) Inventors: Daniel W. Jones, Lenexa, KS (US); Jesse Schmidtberger, Olathe, KS (US); Michael A. Carlson, Stanley, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 0 days.

(21) Appl. No.: 11/161,450

(22) Filed: Aug. 3, 2005

Related U.S. Application Data

(60) Provisional application No. 60/598,382, filed on Aug. 3, 2004, provisional application No. 60/624,853, filed on Nov. 3, 2004, provisional application No. 60/628,995, filed on Nov. 18, 2004.

(51) Int. Cl.
*B63B 35/73* (2006.01)

(52) U.S. Cl. ..... 440/88 A; 440/111

(58) Field of Classification Search ..... 114/55.5; 440/38, 88 A, 88 L, 111, 88 R
See application file for complete search history.

(56) References Cited

U.S. PATENT DOCUMENTS

| | | | | |
|---|---|---|---|---|
| 5,699,766 | A | 12/1997 | Saito | |
| 5,746,054 | A | 5/1998 | Matte | |
| 5,806,496 | A | 9/1998 | Saito | |
| 5,908,013 | A | 6/1999 | Dyess | |
| 5,953,909 | A | 9/1999 | Waltrip, II | |
| 5,967,868 | A * | 10/1999 | Ito et al. | 440/111 |
| 6,016,655 | A | 1/2000 | Boswell | |
| 6,358,109 | B1 | 3/2002 | Neisen | |
| 6,390,869 | B1 | 5/2002 | Korenjak et al. | |
| 6,397,759 | B1 | 6/2002 | Hubert et al. | |
| 6,415,728 | B1 * | 7/2002 | Maeda et al. | 440/111 |
| 6,415,759 | B1 | 7/2002 | Ohrnberger et al. | |
| 6,446,744 | B1 | 9/2002 | Wubbolts et al. | |
| 6,544,085 | B1 | 4/2003 | Ménard et al. | |
| 6,544,086 | B1 | 4/2003 | Tscherne et al. | |
| 6,547,027 | B1 | 4/2003 | Kalhok et al. | |
| 6,551,155 | B1 | 4/2003 | Lecours et al. | |
| 6,568,376 | B1 | 5/2003 | Sonnleitner et al. | |
| 6,568,970 | B1 | 5/2003 | Berthiaume et al. | |
| 6,591,819 | B1 | 7/2003 | Tscherne et al. | |

(Continued)

FOREIGN PATENT DOCUMENTS

| | | |
|---|---|---|
| JP | 2001-146197 | 5/2001 |

(Continued)

*Primary Examiner*—Lars A. Olson
(74) *Attorney, Agent, or Firm*—Hovey Williams LLP

(57) ABSTRACT

A personal watercraft is disclosed as having a forced air induction system that is particularly suitable for aftermarket installation. The induction system includes support structure for supporting the compressor in a non-cantilevered manner within the watercraft body. In supercharger applications, the induction system provides a drive arrangement for powering the supercharger that eliminates or reduces the need to remove the jet pump driveshaft. The belt drive embodiment includes a pulley having a fluid flow passageway extending inwardly from the belt-engaging surface so as to relieve any hydrodynamic forces between the belt and pulley. A body-engaging plate of the support structure is associated with a high-friction material pad for frictionally enhancing the securement of the plate to the body. The support structure further includes a fire extinguisher mount removably supporting a fire extinguisher within the interior space of the body.

87 Claims, 25 Drawing Sheets

U.S. PATENT DOCUMENTS

| | | | |
|---|---|---|---|
| 6,592,415 | B1 | 7/2003 | Berthiaume |
| 6,601,528 | B1 | 8/2003 | Bilek et al. |
| 6,604,594 | B1 | 8/2003 | Wubbolts et al. |
| 6,612,883 | B1 | 9/2003 | Gokan et al. |
| 6,626,140 | B1 | 9/2003 | Aichinger et al. |
| 6,651,765 | B1 | 11/2003 | Weinzierl |
| 6,655,307 | B1 | 12/2003 | Gokan |
| 6,659,089 | B1 | 12/2003 | Gokan et al. |
| 6,676,464 | B1 | 1/2004 | Gokan et al. |
| 6,681,708 | B1 | 1/2004 | Gokan |
| 6,688,928 | B1 | 2/2004 | Gokan et al. |
| 6,688,929 | B1 | 2/2004 | Lecours et al. |
| 6,699,088 | B1 | 3/2004 | Gokan |
| 6,708,634 | B1 | 3/2004 | Gokan et al. |
| 6,708,653 | B1 | 3/2004 | Lefrançois et al. |
| 6,716,076 | B1 | 4/2004 | Gokan et al. |
| 6,718,955 | B1 | 4/2004 | Knight |
| 6,719,598 | B1 | 4/2004 | Gokan et al. |
| 6,743,063 | B1 | 6/2004 | Gokan |
| 6,746,288 | B1 | 6/2004 | Gokan |
| 6,752,010 | B1 | 6/2004 | Gokan et al. |
| 6,758,197 | B1 | 7/2004 | Korenjak et al. |
| 6,758,704 | B1 | 7/2004 | Funayose et al. |
| 6,761,601 | B1 | 7/2004 | Nakajima et al. |
| 6,763,814 | B1 | 7/2004 | Gokan |
| 6,769,942 | B1 | 8/2004 | Bourret et al. |
| 6,773,317 | B1 | 8/2004 | Dagenais et al. |
| 6,796,289 | B1 | 9/2004 | Uraki et al. |
| 6,810,869 | B1 | 11/2004 | Gokan et al. |
| 6,837,210 | B1 | 1/2005 | Tsuchiya et al. |
| 6,848,528 | B1 | 2/2005 | Pichler et al. |
| 6,848,957 | B1 | 2/2005 | Yashiro et al. |
| 6,868,938 | B1 | 3/2005 | Lecours |
| 6,875,070 | B1 | 4/2005 | Nakajima et al. |
| 6,877,494 | B1 | 4/2005 | White et al. |
| 6,918,804 | B1 | 7/2005 | Matsuda |
| 6,925,948 | B1 | 8/2005 | Nakajima |
| 6,929,081 | B1 | 8/2005 | Pichler et al. |
| 6,942,017 | B1 | 9/2005 | Gokan et al. |
| 2001/0007235 | A1 | 7/2001 | Dynes et al. |
| 2001/0044352 | A1 | 11/2001 | Korenjak et al. |
| 2002/0011222 | A1 | 1/2002 | Bilek et al. |
| 2002/0025742 | A1 | 2/2002 | Berthiaume et al. |
| 2002/0084125 | A1 | 7/2002 | Scheumacher et al. |
| 2002/0124783 | A1 | 9/2002 | Dynes |
| 2004/0007192 | A1 | 1/2004 | Keoppel |
| 2004/0069250 | A1 | 4/2004 | Aichinger et al. |
| 2004/0083730 | A1 | 5/2004 | Wizgall et al. |
| 2004/0182621 | A1 | 9/2004 | Yatagai et al. |
| 2004/0182622 | A1 | 9/2004 | Yatagai et al. |
| 2004/0182624 | A1 | 9/2004 | Yatagai et al. |
| 2004/0188159 | A1 | 9/2004 | Yatagai et al. |
| 2004/0206340 | A1 | 10/2004 | Bilek et al. |
| 2004/0211398 | A1 | 10/2004 | Knight |
| 2004/0235369 | A1 | 11/2004 | Nakajima et al. |
| 2004/0238252 | A1 | 12/2004 | Weinzierl |
| 2005/0028795 | A1 | 2/2005 | Benson |
| 2005/0145232 | A1 | 7/2005 | White et al. |
| 2005/0172919 | A1 | 8/2005 | Ozaki et al. |
| 2005/0204730 | A1 | 9/2005 | Tsukahara et al. |
| 2005/0205319 | A1 | 9/2005 | Yatagi et al. |
| 2005/0247498 | A1 | 11/2005 | Pichler et al. |
| 2005/0263127 | A1 | 12/2005 | Pigott et al. |
| 2005/0268878 | A1 | 12/2005 | Ito |
| 2005/0279092 | A1 | 12/2005 | Ozawa |
| 2005/0279335 | A1 | 12/2005 | Ozawa |
| 2005/0279552 | A1 | 12/2005 | Schuehmacher et al. |
| 2006/0016437 | A1 | 1/2006 | Ozawa |

FOREIGN PATENT DOCUMENTS

| | | |
|---|---|---|
| JP | 2003-35150 | 2/2003 |
| WO | WO0165087 | 9/2001 |
| WO | WO0165091 | 9/2001 |
| WO | WO0165093 | 9/2001 |

* cited by examiner

PERSONAL WATERCRAFT FORCED AIR INDUCTION SYSTEM

RELATED APPLICATIONS

This application claims the priority of Provisional Application Ser. No. 60/598,382, filed Aug. 3, 2004, entitled Supercharger Drive for a Personal Watercraft; Provisional Application Ser. No. 60/624,853, filed Nov. 3, 2004, entitled Personal Watercraft Having Supercharger Induction System; and Provisional Application Ser. No. 60/628,995, filed Nov. 18, 2004, entitled Personal Watercraft Having Supercharger Induction System; all of which are hereby incorporated by reference herein.

BACKGROUND OF THE INVENTION

1. Field of the Invention

The present invention relates generally to personal watercraft. More particularly, the present invention concerns a personal watercraft having a forced air induction system, wherein the system is particularly suitable for use in aftermarket bolt-on applications, although the principles of the present invention are not limited to such applications.

2. Discussion of Prior Art

Those ordinarily skilled in the art will appreciate that personal watercraft have traditionally included a normally aspirated engine for powering the water jet pump which propels the vessel. Although there have been attempts to provide aftermarket forced air induction systems to "boost" the horsepower of the engine, such expedients are problematic. For example, conventional aftermarket induction systems fail to provide the horsepower gains that most users desire. It has been determined that this may be attributable to a number of deficiencies in conventional designs. Beyond the compressor itself, one such deficiency concerns the manner in which the compressor has previously been mounted within the engine room. The supercharger often experiences significant acceleration, deceleration, and impact loads during operation. Structural support which permits any shaft deflections or bearing misalignment caused by these operating conditions can be catastrophic. Furthermore, with respect to supercharger applications, traditional drives mechanisms for the induction system have failed to reliably and efficiently transmit power to the supercharger, while maintaining serviceability of the watercraft driveline and reducing the complexity of system installation.

Forced air inductions systems are now also being sold as part of the original equipment from the watercraft manufacturer. Such conventional "OEM" induction systems suffer from many, if not all, of the problems presented by the aftermarket systems.

SUMMARY OF THE INVENTION

A first aspect of the present invention concerns a personal watercraft including a body configured to support at least one rider, with the body defining an interior space. The watercraft further includes an engine contained within the body and a forced air induction system operable to pressurize intake fluid and deliver the pressurized fluid to the engine. The induction system includes a compressor having a case in which intake fluid is pressurized when the compressor is powered. The system further includes support structure separate from the engine and coupled to the case to support the compressor on the body within the interior space. The support structure is attached to the body at spaced apart attachment locations, at least two of which are situated on the body so that part of the interior space is defined therebetween. The support structure supports the compressor between the at least two attachment locations so as to provide non-cantilevered support of the compressor.

A second aspect of the present invention concerns a personal watercraft including a body configured to support at least one rider. The watercraft further includes an engine contained within the body and a water jet pump adjacent the stern of the body. The watercraft also includes a driveline drivingly connecting the jet pump to the engine, with the driveline including a rotatable shaft. Yet further, the watercraft includes a forced air induction system operable to supercharge intake fluid and deliver the supercharged fluid to the engine. The induction system includes a supercharger including a rotatable input shaft. A drive mechanism of the induction system is configured to supply power from the engine to the input shaft of the supercharger. The drive mechanism includes a driving member fixed to the shaft, a driven member fixed to the input shaft, at least one rotatable idler member associated with the driving member, and an endless element entraining the members. The endless element presents opposite member engaging surfaces, an outer one of which engages the driving member and an inner one of which engages the at least one idler member.

According to another aspect of the present invention, a personal watercraft includes a body configured to support at least one rider and an engine contained within the body. The watercraft also includes a water jet pump adjacent the stern of the body. A driveline drivingly connects the jet pump to the engine, with the driveline including a rotatable shaft extending between the engine and jet pump. The watercraft further includes a forced air induction system operable to supercharge intake fluid and deliver the supercharged fluid to the engine. The induction system includes a supercharger having a rotatable input shaft. A drive mechanism of the induction system is configured to supply power from the engine to the input shaft of the supercharger. The drive mechanism includes a driving member fixed to the shaft and a driven member fixed to the input shaft, with the members being drivingly interconnected. The driving member is sectioned into a plurality of segments that are interconnected and fixed to the shaft, such that the driving member can be fixed to the shaft without having to remove the shaft.

Yet another aspect of the present invention concerns a personal watercraft including a body configured to support at least one rider and an engine contained within the body. The watercraft also includes a water jet pump adjacent the stern of the body. A driveline of the watercraft serves to drivingly connect the jet pump to the engine. The driveline includes a rotatable shaft. The watercraft further includes a forced air induction system operable to supercharge intake fluid and deliver the supercharged fluid to the engine. The induction system includes a supercharger having a rotatable input shaft. A drive mechanism of the induction system is configured to supply power from the engine to the input shaft of the supercharger. The drive mechanism includes a driving pulley fixed to the shaft, a driven pulley fixed to the input shaft, and an endless belt entraining the pulleys. At least one of the pulleys presenting a belt-engaging surface and a recessed fluid flow passageway extending inwardly from the belt-engaging surface to relieve hydrodynamic forces between the at least one of the pulleys and the belt.

Another aspect of the present invention concerns a personal watercraft comprising a body configured to support at least one rider, with the body defining an interior space. The watercraft also includes an engine contained within the body and a forced air induction system operable to pressurize intake fluid and deliver the pressurized fluid to the engine. The induction system includes a compressor including a case in which intake fluid is pressurized when the compressor is powered. Support structure coupled to the case serves to support the compressor on the body within the interior space. The support structure includes a body-engaging plate that extends alongside the body and is secured thereto. The support structure further includes a pad of high-friction material between the plate and body for frictionally enhancing the connection between the plate and body.

In accordance with another aspect of the present invention, a personal watercraft includes a body configured to support at least one rider, with the body defining an interior space. The watercraft also includes an engine contained within the body, a fire extinguisher, and a forced air induction system operable to pressurize intake fluid and deliver the pressurized fluid to the engine. The induction system includes a compressor having a case in which intake fluid is pressurized when the compressor is powered. The induction system further includes a support frame coupled to the case to support the compressor on the body within the interior space. The support frame includes a fire extinguisher mount that removably supports the fire extinguisher within the interior space.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 25:
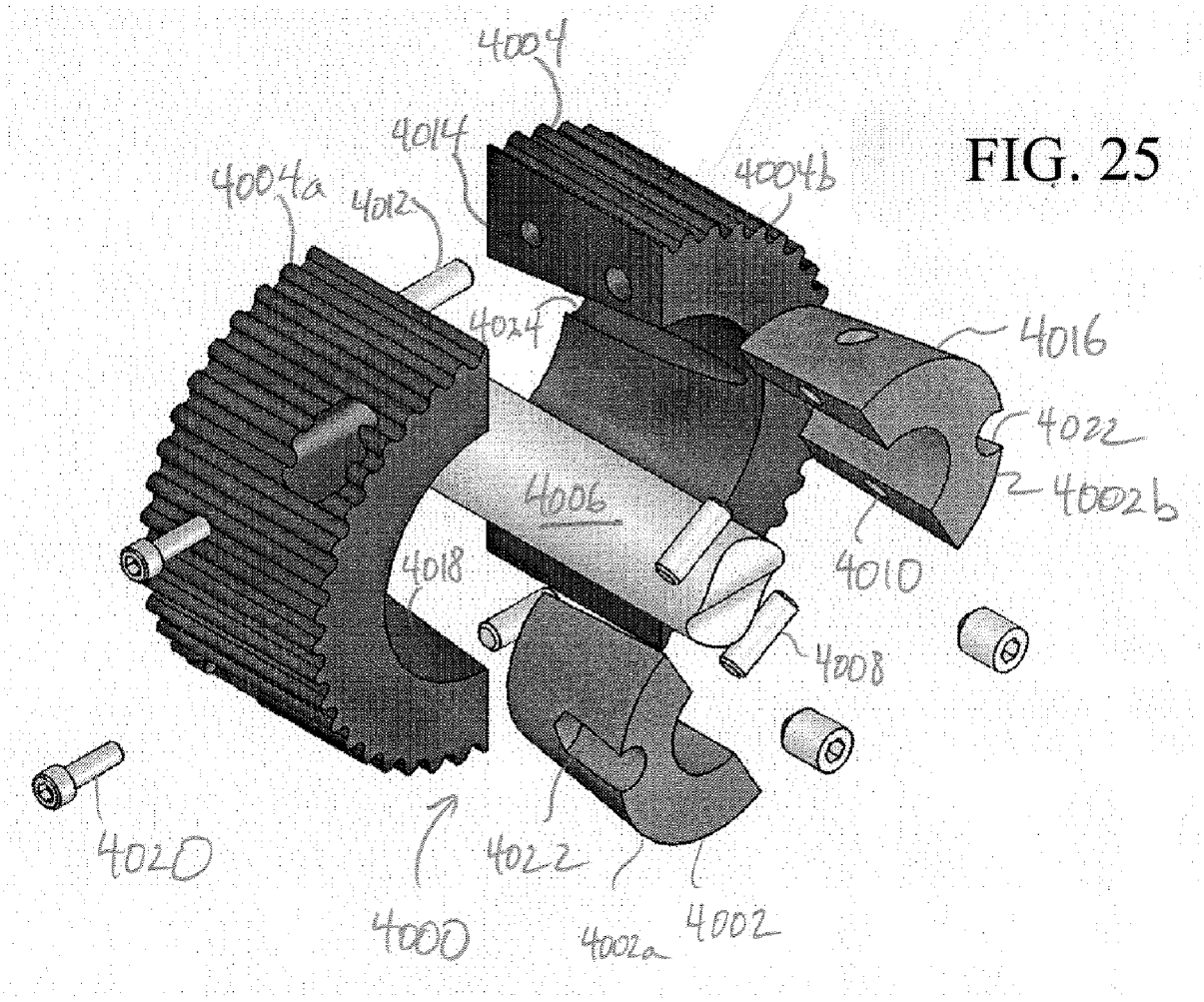
Figure 26:
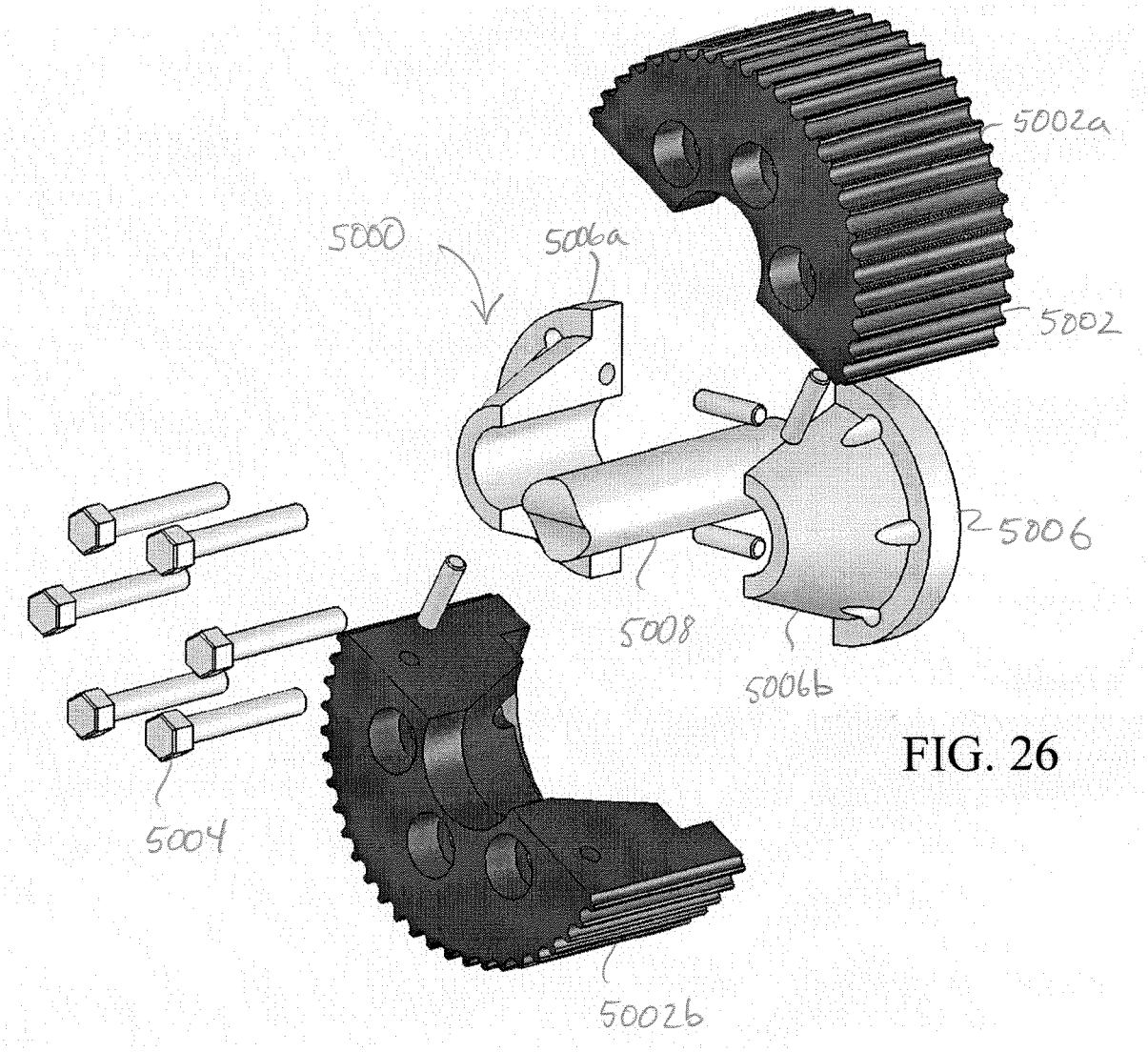

FIG. 25 is an exploded perspective view of an alternative driving pulley design, particularly illustrating the sections of the tapered bushing and power-transmitting component before being fixed to the driveshaft; and FIG. 26 is an exploded perspective view of yet another alternative driving pulley design, particularly illustrating the sections of the tapered bushing and power-transmitting component before being fixed to the driveshaft.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Figure 1:
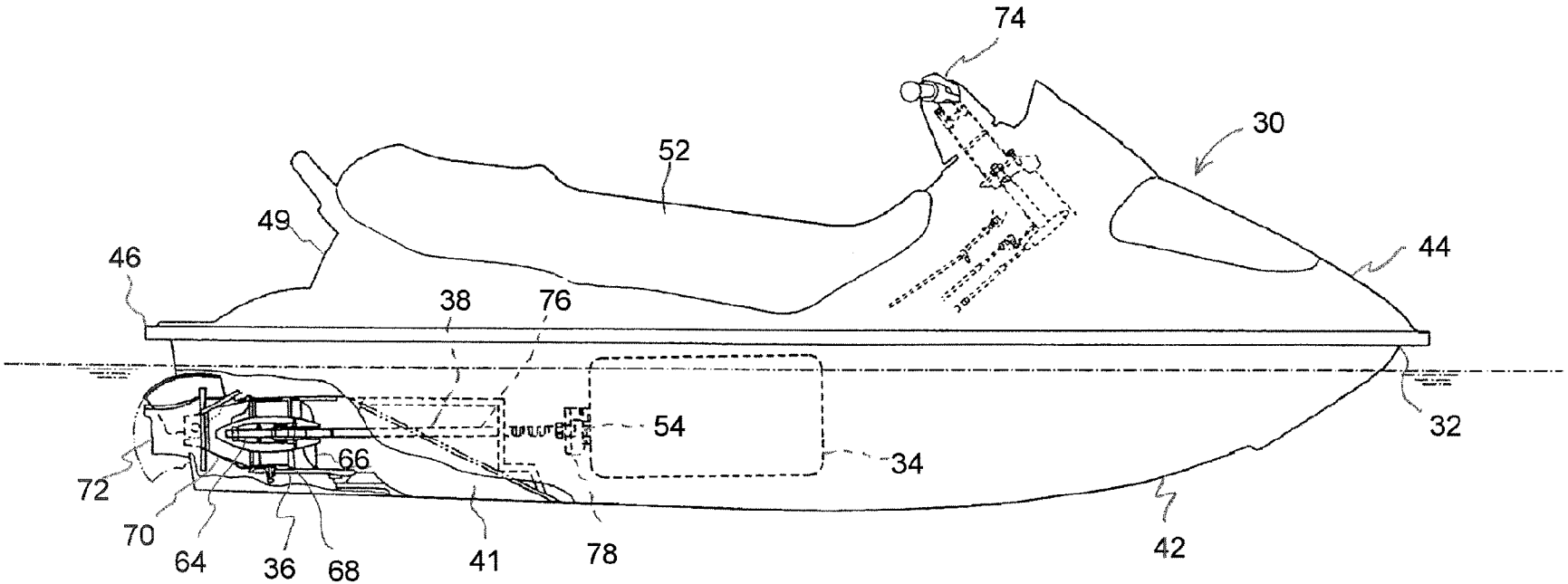
FIG. 1 is a side elevation view of a personal watercraft constructed in accordance with the principles of a preferred embodiment of the present invention (viewing the watercraft from the starboard side), with part of the hull being broken away to show the jet pump and other internal constructional details being shown schematically.
Figure 2:
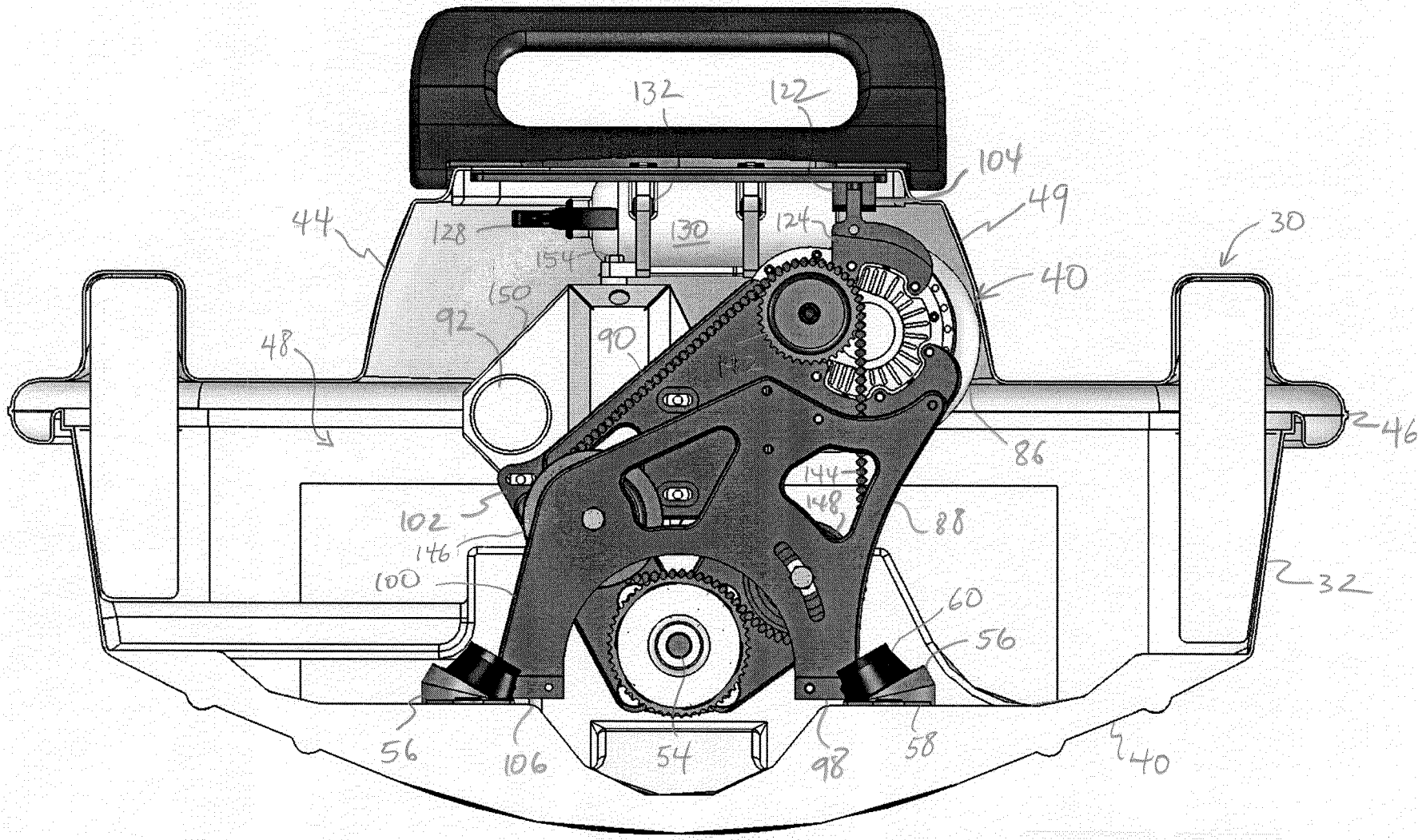
FIG. 2 is a vertical cross-sectional view of the personal watercraft, particularly depicting the forced air induction system as it is viewed toward the stern of the craft, with certain internal components (e.g., the jet pump) being removed for purposes of clarity.

The personal watercraft 30 selected for illustration generally includes a body 32, an engine 34 contained within the body, a jet pump 36 for propelling the watercraft, a driveline 38 for providing power from the engine 34 to the jet pump 36, and a forced air induction system 38 for pressurizing intake air supplied to the engine 34 (see FIGS. 1 and 2). It is particularly noted that the watercraft 30 is shown schematically in FIG. 1, as most of the constructional details of the watercraft (apart from the induction system 38 and certain components of the driveline 38) are not critical to the principles of the present invention. That is to say, the present invention encompasses virtually any suitable type of personal watercraft. The illustrated embodiments happen to be particularly designed for use in the Model STX-15F sold by Kawasaki; however, the principles of the present invention are equally applicable to other models and brands of personal watercraft, including those available from Yamaha, Bombardier, and Honda.

The watercraft body 32 includes a hull 42 presenting an open top that is covered by a deck 44. A water intake 41 is defined in the bottom of the hull adjacent the stern of the craft 30. The hull 44 and deck 46 are joined along a gunnel line 46 and cooperatively define an interior space 48. The interior space 48 preferably defines an engine room in which the engine 34 and induction system 40 are preferably located, although certain aspects of the present invention encompass an arrangement in which the engine and induction system are in generally separate interior spaces. An upper wall 49 of the deck 46 presents an access opening 50 defined at the top of the interior space 48. As is customary, the access opening 50 is selectively covered by a removable seat 52. In the traditional manner, the body 32 is formed primarily of fiberglass with suitable reinforcement inserts (not shown) being provided as necessary (e.g., metal channels extending along the length of the hull for supporting the engine).

The illustrated watercraft 30 is arranged so that one or more riders straddle the seat 52. Those ordinarily skilled in the art will appreciate, however, that other rider positions are often provided by a personal watercraft. For example, some alternative personal watercraft configurations permit the rider to kneel, stand, or sit in other seated positions on the craft. Some personal watercraft are convertible so that the rider's position on the vessel can be changed as desired. Those ordinarily skilled in the art will appreciate that the term "personal watercraft" as used herein generally refers to a vessel that is normally propelled by an engine-driven jet pump, wherein the vessel is operated by a person (or persons) who stands, kneels, or sits on (as opposed to in) the craft.

The engine 34 is preferably of the four cylinder four-stroke variety, although other engine configurations are within the ambit of the present invention. The engine has in intake (not shown) in which pressurized air is supplied from the induction system 40. As is customary, the engine 34 is arranged so that its output shaft 54 (which can take the form of the crankshaft or an intermediate shaft fixed to the crankshaft) extends longitudinally between the bow and stern of the body 32 (see FIGS. 1 and 8). The output shaft 54 is drivingly connected to the jet pump 36 by the driveline 38. The engine 34 is supported on the hull 42 by a plurality of engine mounts 56 (see FIGS. 2–7). The illustrated engine mounts 56 are conventional in design and each include a metal base 58 fixed to the hull 42 and an elastomeric coupler 60 coupled to the base 58. As previously noted, the bases 58 are preferably secured to a metal channel (not shown) set within the hull 42 by fasteners 62. The engine 34 is supported on the couplers 60 so as to reduce vibration to the hull 42.

As best shown in FIG. 1, the jet pump 36 has a traditional design and is located just behind the water intake 41. The pump 36 serves to accelerate and pressurize water so as to propel the craft 30. It shall be sufficient to explain that the pump 36 includes a shaft 64 carrying an impeller 66 which rotates within a casing 68. Power from the engine 34 is supplied to the shaft 64 by the driveline 38. A pump nozzle 70 extends rearwardly from the casing 68 to a moveable steering nozzle 72. The steering nozzle 72 is operatively connected to a handlebar-type steering mechanism 74, although other suitable steering mechanisms (e.g., a rotatable steering wheel) are within the ambit of the present invention. Thus, as the rider turns the mechanism 74, the nozzle 72 is moved in an opposite direction to propel the craft 30 in the desired direction (assuming the impeller speed is sufficient to propel the craft 30).

The driveline 38 drivingly interconnects the output shaft 54 of the engine 34 and the pump shaft 64 of the pump 36. In the preferred embodiment, the driveline 38 includes a single driveshaft 75 extending between the shafts 54 and 64 to transmit power from the engine 34 to the pump 36. A coupler 78 is preferably provided to couple the driveshaft 75 to the output shaft 54 in a manner that accommodates relative shaft vibrations, positioning, etc. Particularly, the illustrated coupler 78 includes a drive component 80 fixed to the output shaft 54 and a driven component 82 fixed to the driveshaft 76 (see FIGS. 7 and 8). The components 80 and 82 have complemental intermeshing projections which receive a compressible coupling component 84 therebetween. The coupling component 84 is preferably formed of an elastomeric material (although other suitable materials may be used). Again, the coupling component 84 serves to dampen vibration and accommodate any slight misalignment between the shafts 54 and 76. Because the illustrated induction system 40 is mechanically powered, the driveshaft 76 also preferably serves to transmit power from the engine 34 to the induction system 40. Those ordinarily skilled in the art will appreciate that removal of the shaft 76 is complicated and somewhat undesirable. Moreover, a number of aspects of the present invention concern ways in which power for the induction system 40 is supplied by the driveshaft 76, while eliminating or reducing the number of times the driveshaft 76 must be removed to install the system 40 or service the driveline 38 or other components supplying power to the induction system 40. Yet further, certain other aspects of the present invention contemplate supplying power for the mechanically driven induction system from elsewhere within the craft 30 (e.g., directly from the output shaft 54).

Those ordinarily skilled in the art will appreciate that the principles of the present invention are equally applicable to other alternative driveline arrangements. For example, the driveshaft may alternatively be divided into a number of interconnected shaft sections. Another alternative driveline arrangement might include multiple shafts which are axially offset relative to one another such that a drivetrain (e.g., a gear transmission) drivingly interconnects the shafts. Such an arrangement might be necessary in a personal watercraft having a jet pump shaft that is offset from the engine output shaft.

The illustrated induction system 40 generally includes a compressor 86, support structure 88 for supporting the compressor 80 within the body 32, a drive mechanism 90 for supplying power to the compressor 86, and a pressurized fluid path 92 extending from the compressor 86 to the engine intake. The illustrated system 40 is mechanically powered such that the compressor 86 comprises a supercharger. A number of aspects of the present invention, however, are equally applicable to an exhaust-driven turbocharger, in which case the drive mechanism 90 is unnecessary and would be eliminated.

Turning initially to the illustrated supercharger 86, air is preferably supplied from outside the engine room 48 to the supercharger 86, although it is also within the ambit of the present invention to supply air solely from within the engine room 48 or to supply an air mixture from both inside and outside the engine room 48. In any case, the supercharger 86 preferably includes a case 94 in which the supplied air is pressurized and then discharged to the path 92. The supercharger 86 also includes an input shaft 96 which projects outwardly from the case 94 for connection to the drive mechanism 90. The input shaft 96 transmits power to the pressurizing components within the case 94. In the illustrated embodiment, the supercharger 86 is of the centrifugal variety, with a rotatable impeller (not shown) housed within a compressor chamber defined by the case 94. The supercharger 86 also preferably includes a step-up gear-type transmission (also generally not shown other than the input shaft 96) for providing an impeller shaft speed that is greater than that of the input shaft 96. One suitable centrifugal supercharger design is disclosed in co-pending U.S. patent application Ser. No. 10/906,751, filed on Mar. 4, 2005, entitled CENTRIFUGAL COMPRESSOR HAVING ROTATABLE COMPRESSOR CASE INSERT, assigned of record to the assignee of the present invention, which is hereby incorporated by reference herein. However, the principles of the present invention are equally applicable to other varieties of superchargers, such as positive displacement roots superchargers (rotor type blowers), positive displacement screw supercharger (helixed rotor type blowers), or alternatively configured centrifugal superchargers. Furthermore, as previously noted, certain aspects of the present invention encompass any other type of compressor used in a forced air induction system, such as a turbocharger (which often includes a centrifugal impeller rotated in the traditional manner by exhaust power).

The preferred support structure 88 for the compressor is preferably secured to the body 32 at a number of spaced apart attachment locations. As will be explained, securement at such locations can be achieved in any suitable fashion, such as through existing mounts (e.g., the engine mounts 56), specific body mounts dedicated to the induction system (see below), adhesive, etc. Furthermore, it is critical with respect to certain aspects of the present invention that the attachment locations be arranged so that part of the engine room 48 is defined therebetween. Such an arrangement permits the supercharger 86 to be supported in a non-cantilevered manner in this part of the room 48.

As shown in FIGS. 2–9, the support structure 88 generally includes a frame 98 that extends across the interior space 48. The frame 98 generally includes a body-mounting bracket 100 fixed to the hull 42, a compressor bracket 102 fixed to the bracket 100, and a upper brace assembly 104 secured to the deck 44. The illustrated frame 98 extends generally vertically across the space 48 between the bottom of the hull 42 and the top of the deck 44. However, the principles of the present invention are equally applicable to frames (or support structure) that extend generally horizontally or obliquely across the space 48. Furthermore, it is noted that the frame 98 does not itself span the space 48, but rather it cooperates with the compressor 86 to extend completely across the space. It is within the ambit of the present invention, however, to alternatively provide a frame that itself extends completely across the interior space, with the compressor simply being mounted centrally thereto. The present invention also encompasses support structure comprising only a fastener (e.g., a threaded fastener) or body mount (similar to those described herein) for directly interconnecting the compressor and body, wherein the compressor spans most, if not all, of the distance between the attachment locations. Such structure can still be configured so as to support the compressor in the desired manner, as noted herein.

The body-engaging bracket 100 includes a pair of feet 106 that are fastened to the engine mounts 56 and thereby the hull 42. In a retrofit application, one of the original fasteners of each mount 56 is replaced with a relatively longer fastener that passes through both the foot 106 and base 58. The bracket 100 preferably has a generally inverted-U shape to accommodate the output shaft 54 of the engine 34.

Figure 7:
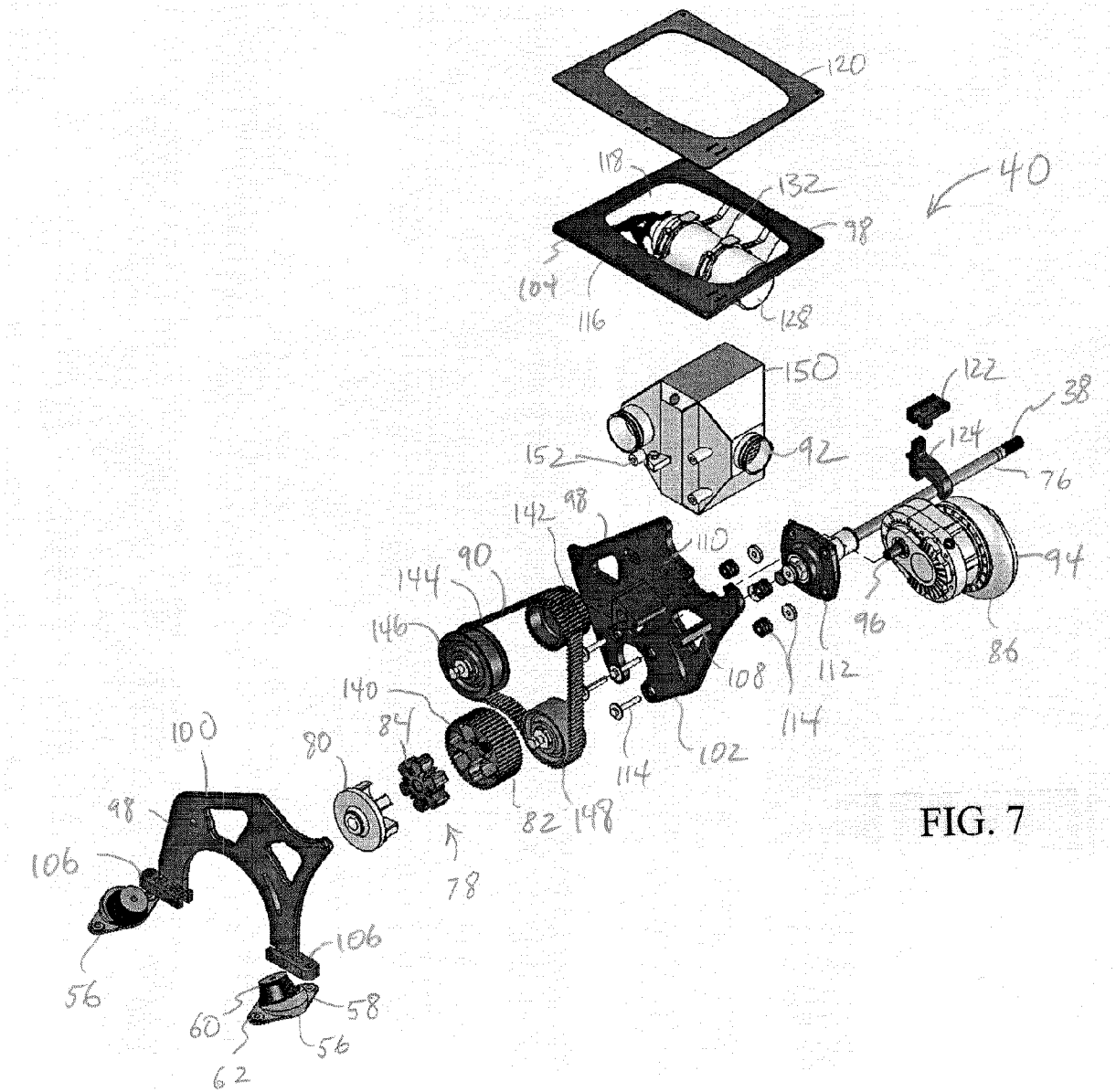
FIG. 7 is an exploded perspective view of the components illustrated in FIGS. 4–7.

The compressor bracket 102 includes a pair of spacers 108 and 110 which serve to position the bracket 102 relative to the bracket 100 (e.g., see FIG. 7). In the illustrated embodiment, the drive mechanism 90 is located between the brackets 100 and 102. The brackets are fastened to one another (preferably by threaded fasteners extending through the spacers 108 and 110), although other suitable configurations may be used (e.g., the brackets could be integrally cast or interconnected by welding, adhesive, etc.). The compressor 86 is attached to the compressor bracket 102 by threaded fasteners extending through the bracket 102 and threadably into the case 94. The bracket 102 carries a driveshaft support 112 including a bearing for rotatably receiving the driveshaft 76. The support 112 is secured to the bracket 102 by a plurality of threaded fastener assemblies 114. In the illustrated embodiment, each fastener assembly 114 includes a bolt, a cinch washer received on the bolt, a unitized center bolt mount coupled to the support 112, and a cinch spacer associated with the support 112 (see FIG. 7). Although the support 112 is not necessary in every application, it is desirable because it minimizes the risk of driveshaft deflection that might otherwise occur due to the driving connection of the mechanism 90 to the driveshaft 76. In this regard, the support 112 is preferably immediately adjacent the driving connection between the mechanism 90 and driveshaft 76. The bracket 102 is open along its lower margin to accommodate the driveshaft 76.

Figure 3:
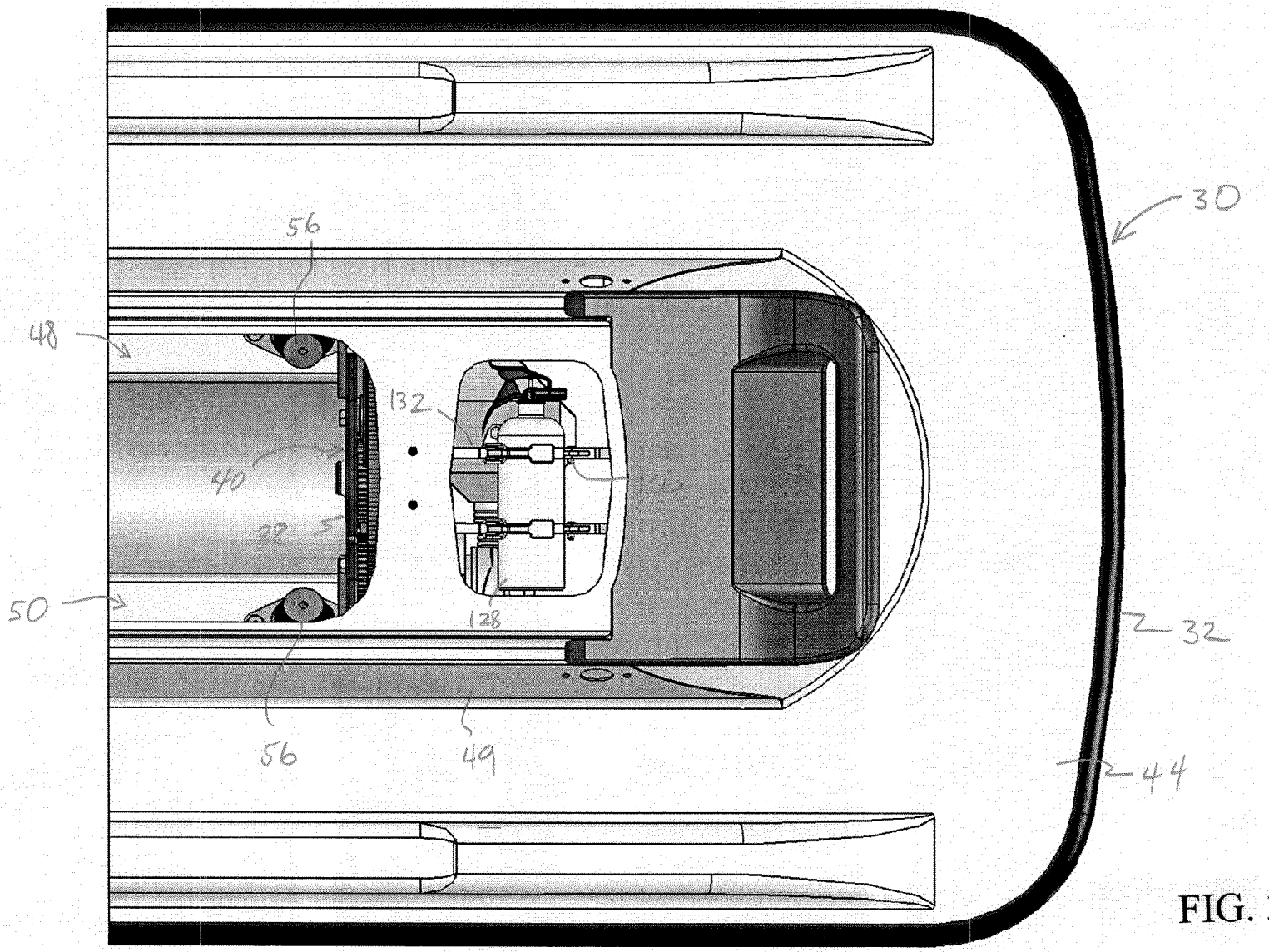
FIG. 3 is a fragmentary top plan view of the stern end of the personal watercraft, with the seat being removed to show the forced air induction system within the engine compartment as viewed through the access opening in the deck.
Figure 4:
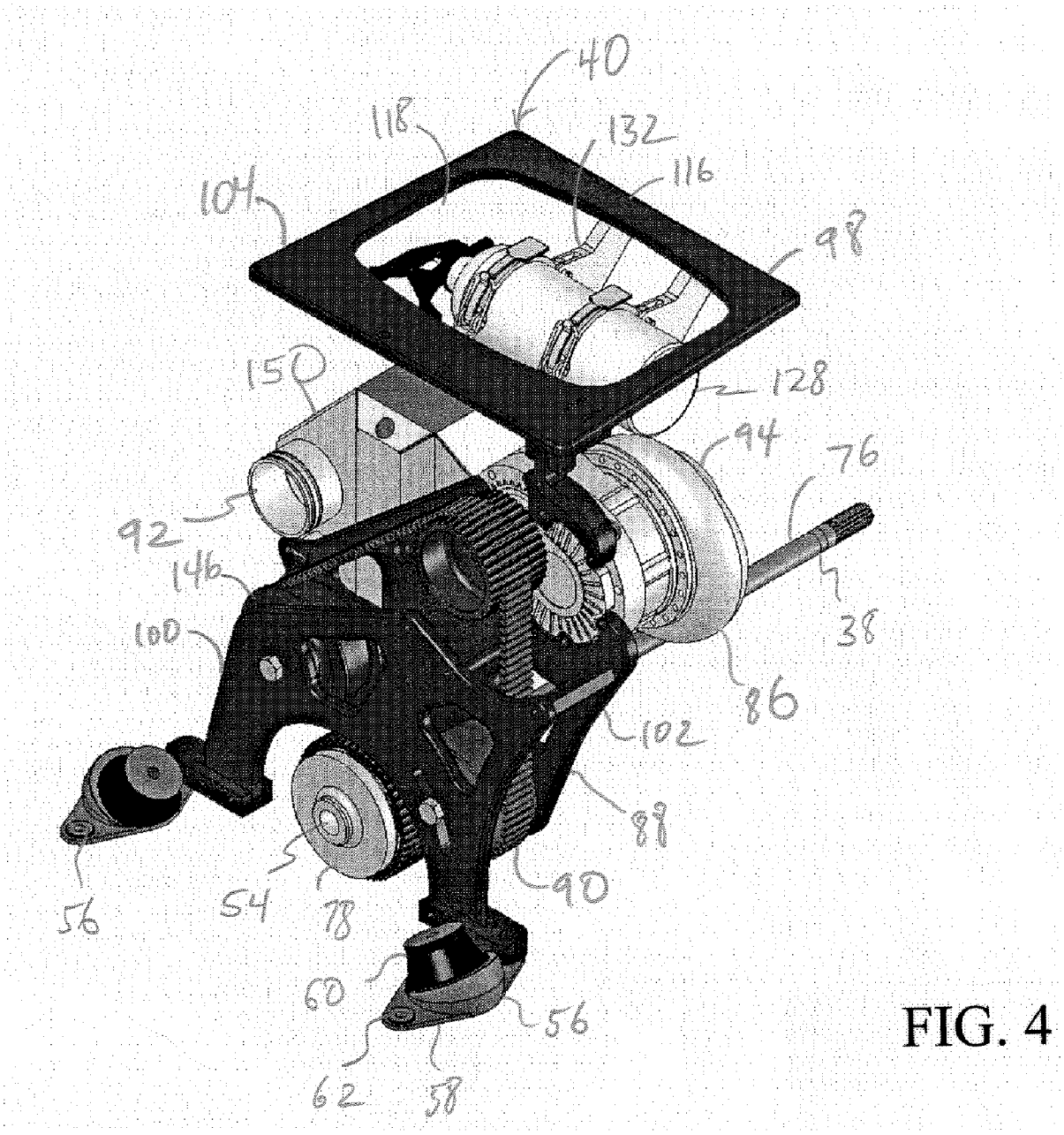
FIG. 4 is perspective view of the forced air induction system and parts of the driveline removed from the watercraft.
Figure 5:
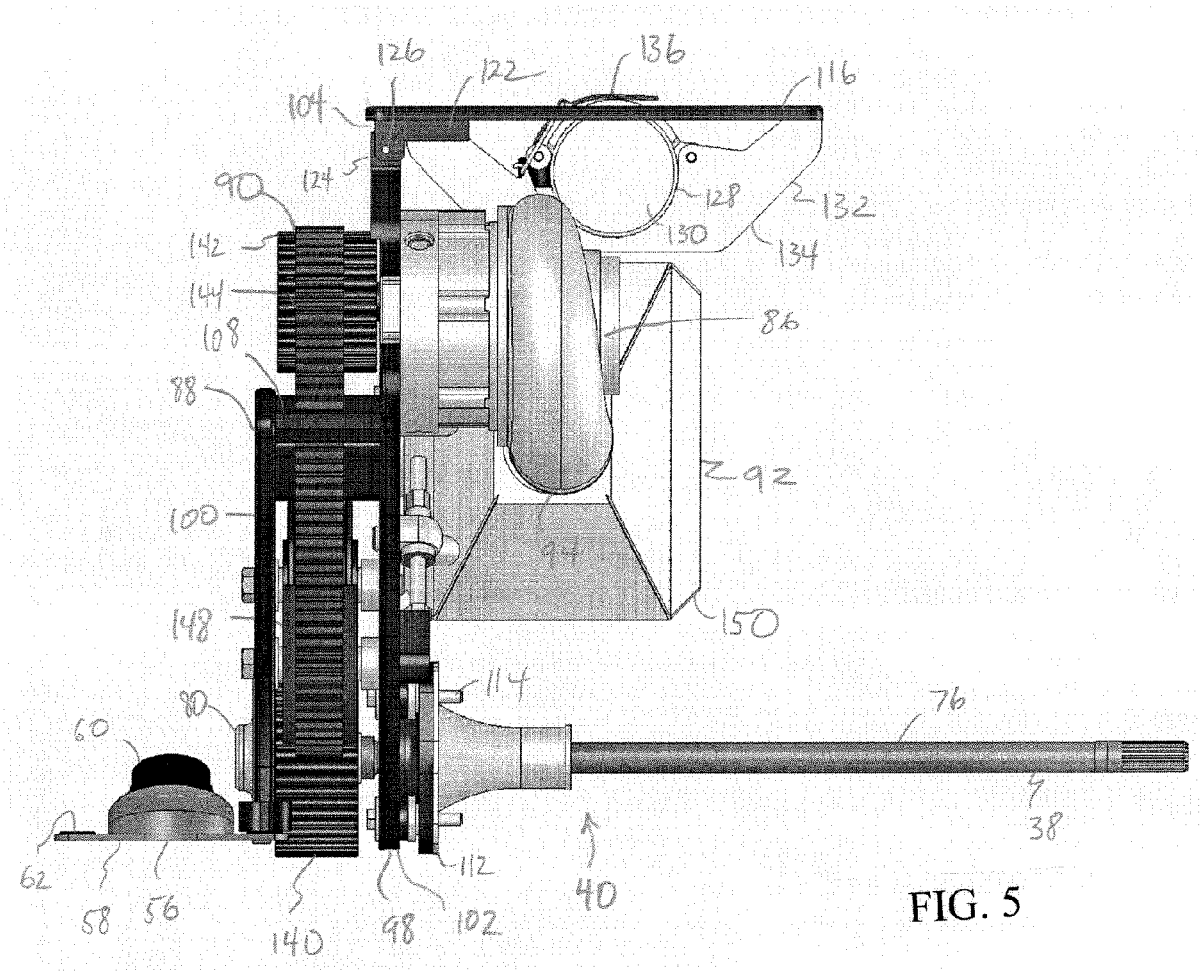
FIG. 5 is a left or port side elevation view of the components illustrated in FIG. 4.
Figure 6:
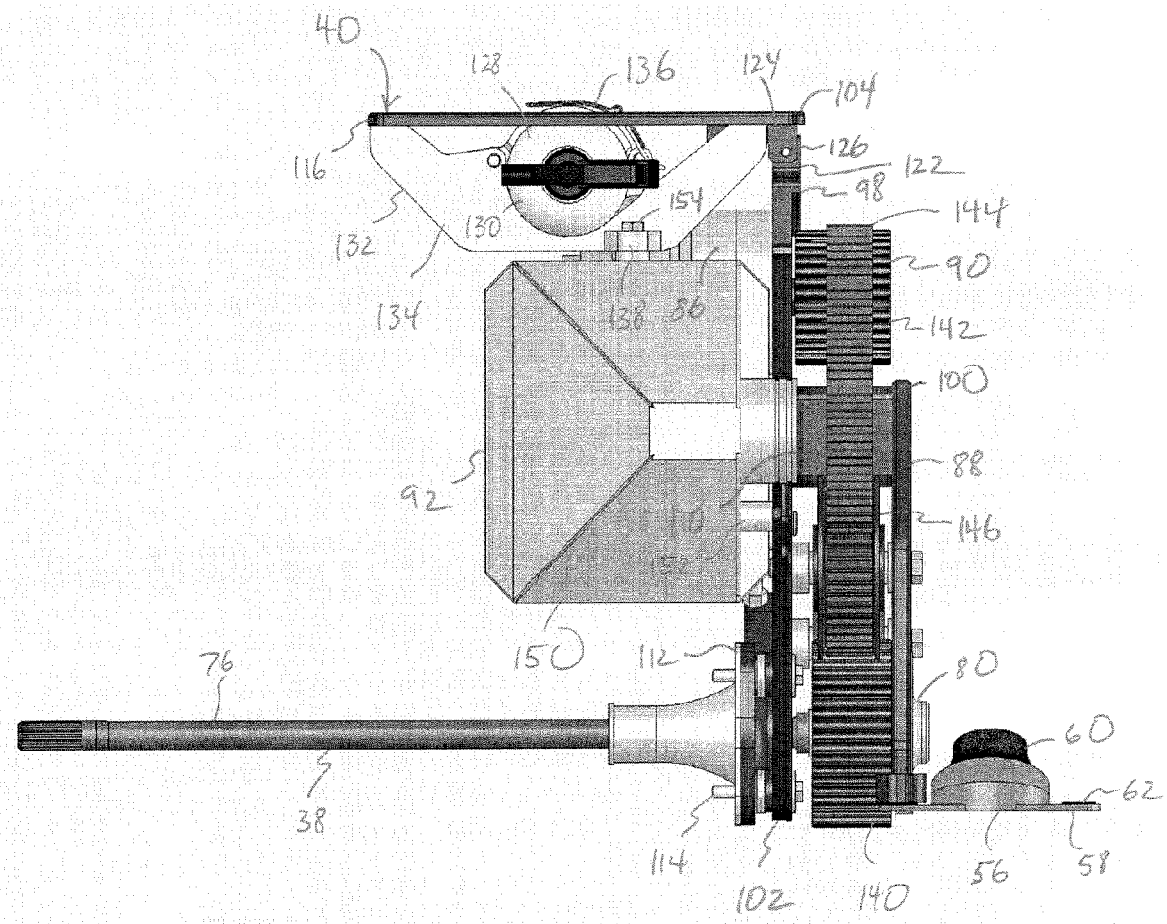
FIG. 6 is a right or starboard side elevation view of the components illustrated in FIGS. 4 and 5.

The upper brace assembly 104 includes a brace plate 116 that presents a central opening 118 (see FIGS. 4 and 7). As shown in FIG. 3, the upper wall 49 of the deck 44 segments the access opening 50, with the brace plate 116 being positioned so that its central opening 118 aligns generally with the rearmost portion of the access opening 50. The brace plate 116 is preferably secured to the upper wall 49 by threaded fasteners. Moreover, the support structure includes a compressible high-friction material pad 120 placed between the upper wall 49 and brace plate 116 to frictionally enhance the interconnection therebetween. The pad 120 is preferably formed of an elastomeric material and, more preferably, is formed of vinyl rubber, buna rubber, or neoprene. The pad 120 preferably has a shape similar to that of the brace plate 116. Furthermore, the pad 120 is preferably configured so as to be compressed when the brace plate 116 is fastened to the deck wall 49. The illustrated arrangement provides secure attachment of the brace plate 116 without requiring excessive or damaging fastener penetration of the body 32. Furthermore, the watercraft body 32 is normally permitted to flex during operation. However, with the support structure 88 extending across the interior space and interconnecting the opposite walls of the body 32, such flexing is restricted by the structure 88. The structure also serves to transfer loads between the opposed walls. The compressible pad 120 therefore operates as a cushion to dampen such loads.

The illustrated brace assembly 104 further includes a plate coupler 122 fixed to the plate 116 by fasteners, although the coupler 122 and plate 116 could alternatively be integrally formed or otherwise attached to one another (e.g., by welding, adhesive, etc.). A compressor coupler 124 is preferably fastened to the supercharger case 94; however, these components could likewise be coupled to one another in other suitable ways. Moreover, the couplers 122 and 124 are pivotally connected by a pin 126 so that the supercharger 86 is shiftably coupled to the brace plate 116. In particular, the supercharger 86 is permitted to pivot about a laterally extending axis but is prevented from moving laterally or in a fore-and-aft direction relative to the plate 116. Such limited adjustability of the supercharger 86 accommodates for variances in body design, manufacturing tolerances, etc.

It shall be apparent from the foregoing description that the preferred support structure 88 serves to support the supercharger 86 within the engine room 48 in a non-cantilevered manner. That is to say, with the support structure 88 attached to the body 32 at spaced apart attachment locations (defined in the illustrated embodiment by the feet 100 of the body-engaging bracket 100 and the brace plate 116) so that part of the interior space 48 is defined therebetween, the supercharger 86 can conveniently be supported between these attachment locations and thereby supported from opposite sides. It has been determined that this type of an arrangement is particularly well suited for withstanding the impact and torsional loads normally associated with a high performance supercharger. In other words, the preferred support structure 88 is particularly effective in reducing the risk of shaft deflection and bearing misalignment of the supercharger that might otherwise occur in alternative mounting arrangements.

As is customary, the watercraft 30 includes a fire extinguisher 128. The preferred extinguisher 128 is of a conventional design and includes a cylindrical cannister 130, although other extinguisher styles may be used. The present invention also contemplates a fire extinguisher mount 132 for securely supporting the extinguisher on the support structure 88 within the engine compartment 48. In the illustrated embodiment, the brace plate 116 preferably carries the fire extinguisher mount 132. The mount 132 includes a pair of arms 134 fixed to the underside of the brace plate 116. The arms 134 cooperatively form a cradle in which the fire extinguisher 128 rests. It is particularly noted that the arms include an upper arcuate surface corresponding to the shape of the cannister 130. A quick release latching mechanism 136 is provided on each arm for clamping the extinguisher 128 in place. The cradle is preferably located in registration with the central opening 118 of the plate 116 and is thereby accessible through the rearmost section of the deck access opening 50. The starboard-side arm includes an ear 138 for purposes which will be described.

The drive mechanism 90 is preferably designed to draw power directly from the driveshaft 76, while maintaining efficient and uncomplicated driveline serviceability and system installation. It is noted that the illustrated mechanism 90 comprises a cogged belt drive; however, certain aspects of the present invention are equally applicable to other belt drives (e.g., V-belt drives, ribbed V-belt drives, a double-sided belt having differently configured sides, etc.), chain drives, or gear trains. Obviously, such alternative arrangements would require the various components of the drive mechanism to be alternatively configured (e.g., a chain drive would require at least some of the rotating members that drivingly contact the chain to be sprockets).

Turning to the embodiment illustrated in FIGS. 1–9, the mechanism 90 includes a cogged driving pulley 140 fixed to the driveshaft 76, a cogged driven pulley 142 fixed to the supercharger input shaft 96, and a double-sided cogged belt 144 drivingly interconnecting the pulleys 140 and 142. In this embodiment, the driving pulley 140 integral with the driven component 82 of the driveline coupler 78. The driven pulley 142 is preferably smaller than the driving pulley 140 so that the rotational speed of the input shaft 96 is greater than that of the driveshaft 76. A pair of idler pulleys 146 and 148 are mounted between the brackets 100 and 102. It is noted that the illustrated pulleys 146 and 148 are not toothed, although such a configuration is within the ambit of the present invention. Furthermore, the brackets 100 and 102 include aligned slotted openings for adjustably supporting the port-side idler pulley 148. If desired, the starboard-side pulley 146 could also or alternatively be adjustably supported by the brackets 100 and 102. Moreover, it is noted that the belt 144 backwraps onto the driving pulley 140. In other words, the outside surface of the belt 144 drivingly entrains the pulley 140, with the idler pulleys 146 and 148 (which are engaged by the inside surface of the belt 144) serving to maintain such contact. This arrangement permits driving power from the driveshaft 76 to be supplied to the belt 144 without requiring the belt to extend around and under the driveshaft 76. Therefore, installation, servicing, and replacement of the belt 144 does not require the driveshaft 76 to be removed. Those ordinarily skilled in the art will appreciate that certain aspects of the present invention do not require this "inverted" belt arrangement. Furthermore, because this embodiment involves driving engagement between the inside surface of the belt 144 and the toothed driven pulley 142, the belt 144 is double-sided and provided with teeth on both the inside and outside surfaces thereof.

As the supercharger 86 is powered, intake air is pressurized and forced through the fluid path 92 to the engine intake. The path 92 may be defined by conventional conduits (not shown), but most preferably includes an intercooler 150 for cooling intake air prior to being supplied to the engine intake. The intercooler 150 is preferably a water-to-air heat exchanger, with cooling water being supplied via the jet pump 36. The intercooler 150 is provided with a number of internally-threaded forward-projecting sleeves for receiving threaded fasteners (not shown) that serve to connect the intercooler 150 to the compressor bracket 102. Furthermore, the intercooler 140 is fastened to the ear 138 of the brace plate 116 by fastener 154 (see FIG. 6). In this regard, similar to the compressor 86, the intercooler 150 is supported by the support structure 88 in a non-cantilevered manner.

A number of alternative embodiments are depicted in the remaining drawings figures. It is particularly noted that FIGS. 10–15 show various alternative structures for supporting the compressor within the interior space 48, while FIGS. 16–26 show various alternative drive arrangements for the induction system. FIGS. 17–26 are particularly directed to alternative driving pulley designs; however, it shall be understood that the principles of the present invention are equally applicable to use of certain ones of the designs with other pulleys of the drive mechanism (e.g., the driven pulley). Furthermore, the alternative pulleys depicted in FIGS. 17–26 are either of the ribbed or cogged variety, although the principles of the present invention should not be limited to the depicted configuration. In fact, certain aspects of the alternative designs are equally applicable to other configurations, such as a chain sprocket, a smooth pulley, etc. Those ordinarily skilled in the art will also appreciate that a number of the constructional details of the alternative embodiments are similar (if not identical) to the embodiment depicted in FIGS. 1–9. Therefore, in the interest of brevity, the description of the alternative embodiments will focus principally on their distinctions relative to one another and relative to the embodiment described hereinabove.

Figure 10:
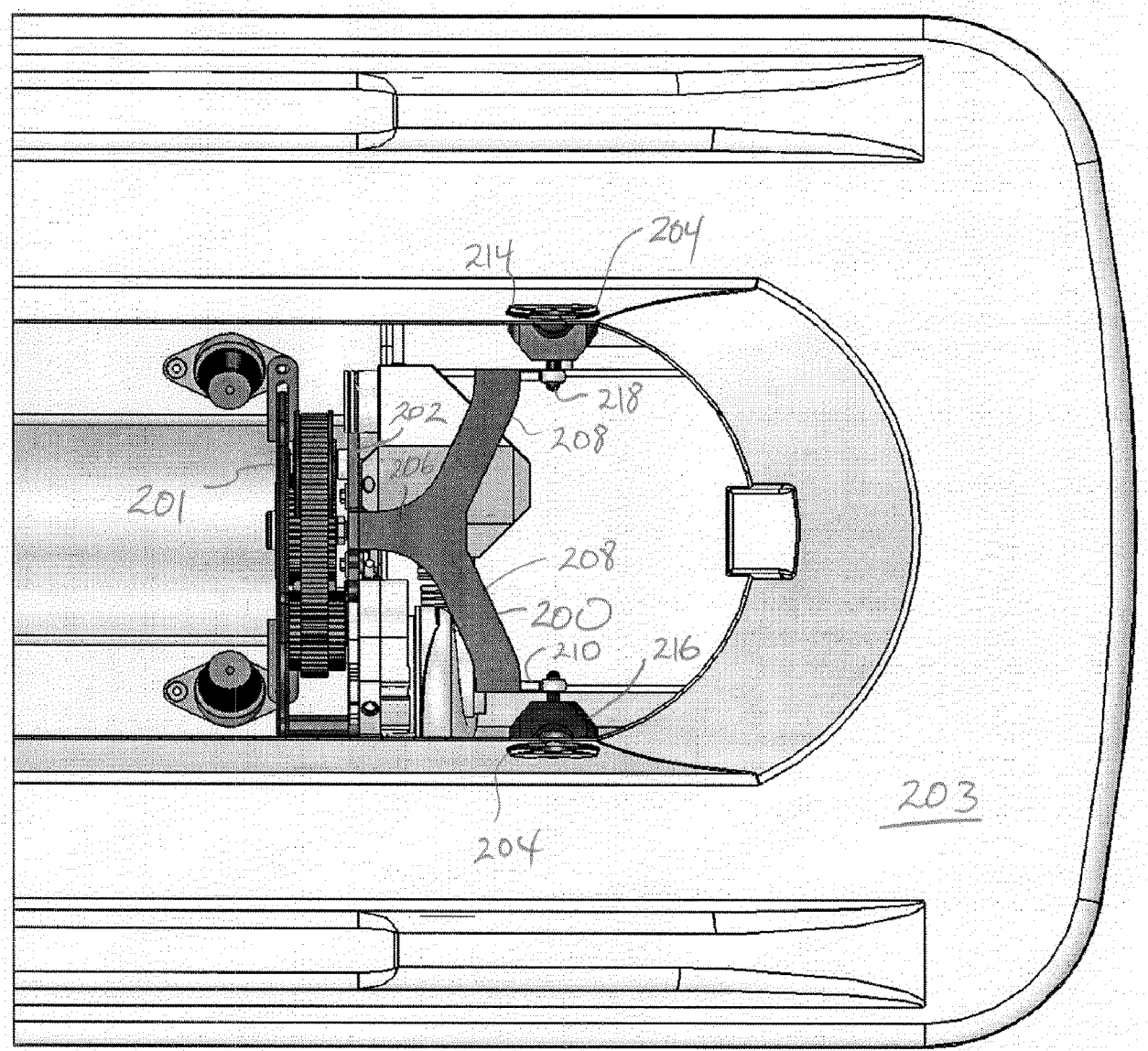
FIG. 10 is fragmentary horizontal cross-sectional view of the stern end of a personal watercraft constructed in accordance with an alternative embodiment of the present invention, with the seat being removed to show the alternative supercharger support structure of the forced air induction as viewed through the access opening in the deck.
Figure 11:
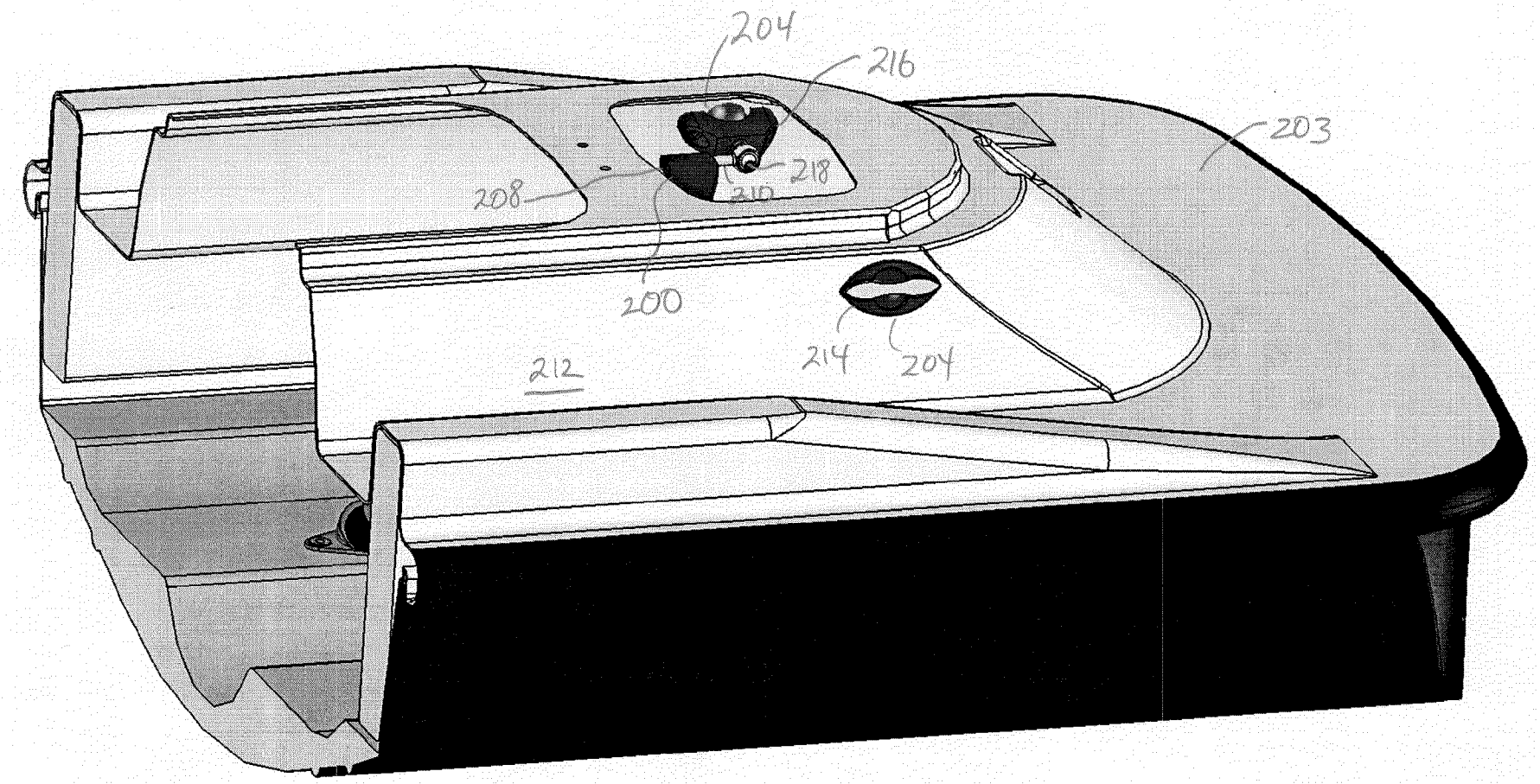
FIG. 11 is a perspective view of the personal watercraft depicted in FIG. 10.
Figure 12:
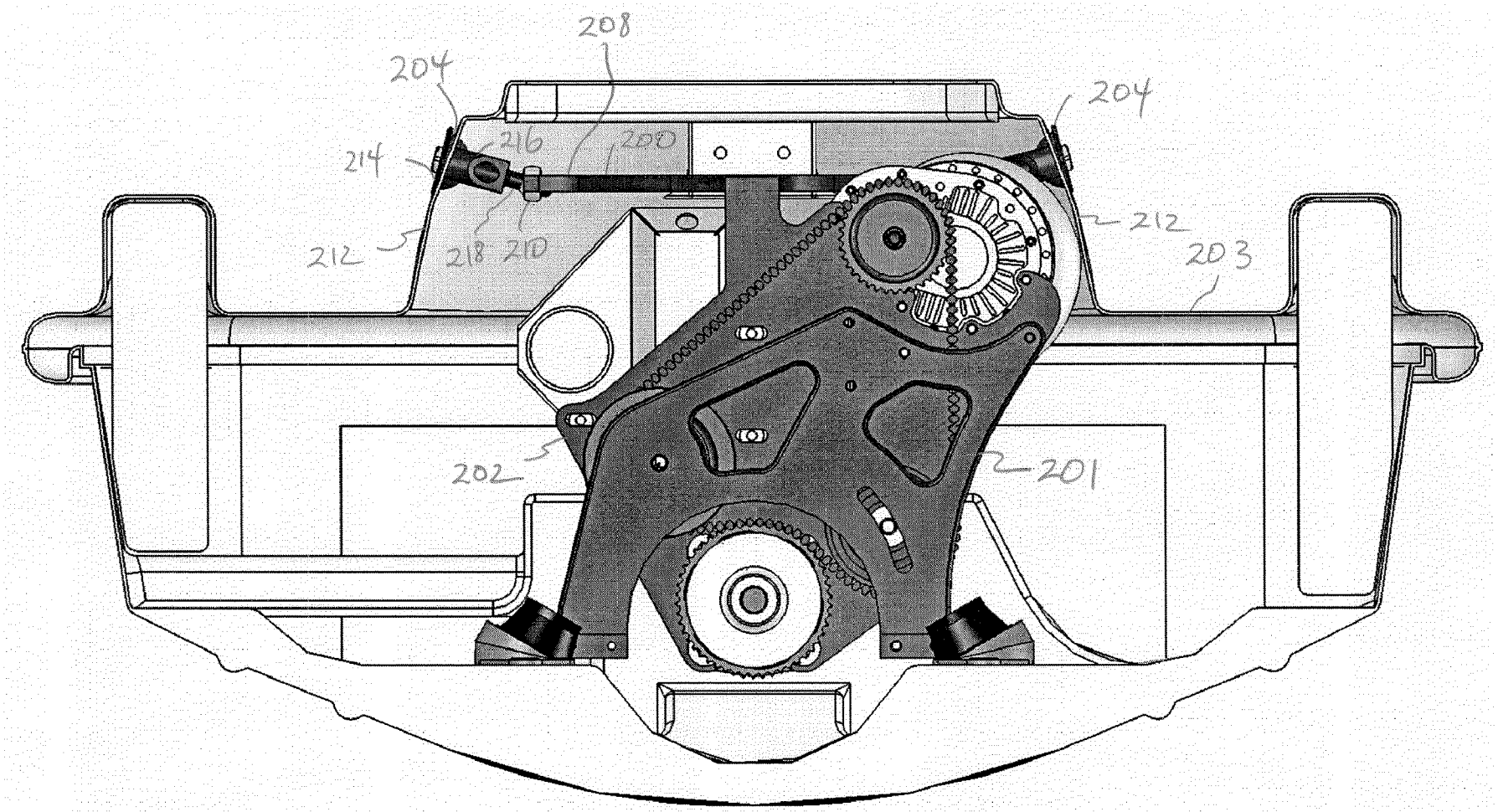
FIG. 12 is a vertical cross-sectional view of the personal watercraft depicted in FIGS. 10 and 11.

Turning specifically to the embodiment depicted in FIGS. 10–12, the support frame 201 includes a Y-shaped bracket 200 projecting rearwardly from the compressor bracket 202 to secure the upper end of the frame to the deck 203. A pair of pivotal deck mounts 204 serve to couple the Y-shaped bracket to deck 203. In particular, the bracket 200 includes a stem 206 suitably fixed to the compressor bracket 202 (e.g., by fasteners, welding, adhesive, etc.) and a pair of arms 208 that project rearwardly toward the mounts 204. At the end of each arm 208 is a connector 210, which may be adjustably coupled to the respective arm to permit adjustment of the connector length relative to the arm. The mounts 204 are generally aligned along the deck sidewall 212. Each mount 204 preferably includes a removable hull hook 214 received within an opening (not shown) of the deck wall 212. A hook bracket 216 is supported on each hook 214 and includes a pin 218 which pivotally connects to the socket end of the respective connector 210.

Figure 13:
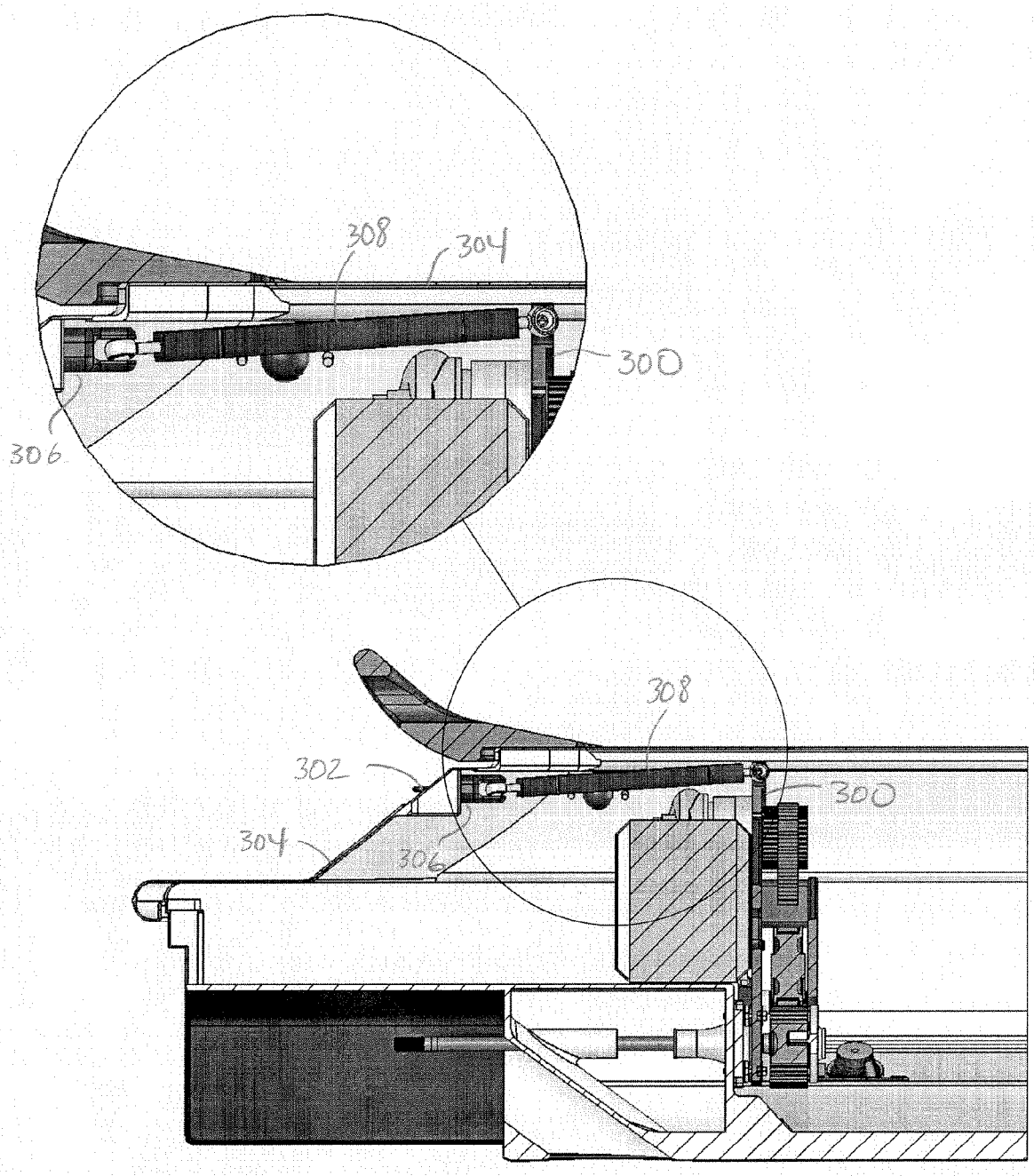
FIG. 13 is a fragmentary vertical cross-sectional view of the stern end of a personal watercraft constructed in accordance with an alternative embodiment of the present invention, particularly illustrating the alternative supercharger support structure of the forced air induction system.

In the embodiment depicted in FIG. 13, the upper end of the compressor bracket 300 is secured to tow cleat 302 of the watercraft body 304. In particular, a cleat bracket 306 is secured to the cleat 302 by suitable means (such as fasteners, adhesive, etc.). An adjustable length tie rod 308 interconnects the compressor bracket 300 and cleat bracket 306. Preferably, the tie rod 308 is pivotally connected to the brackets 300 and 306.

Figure 14:
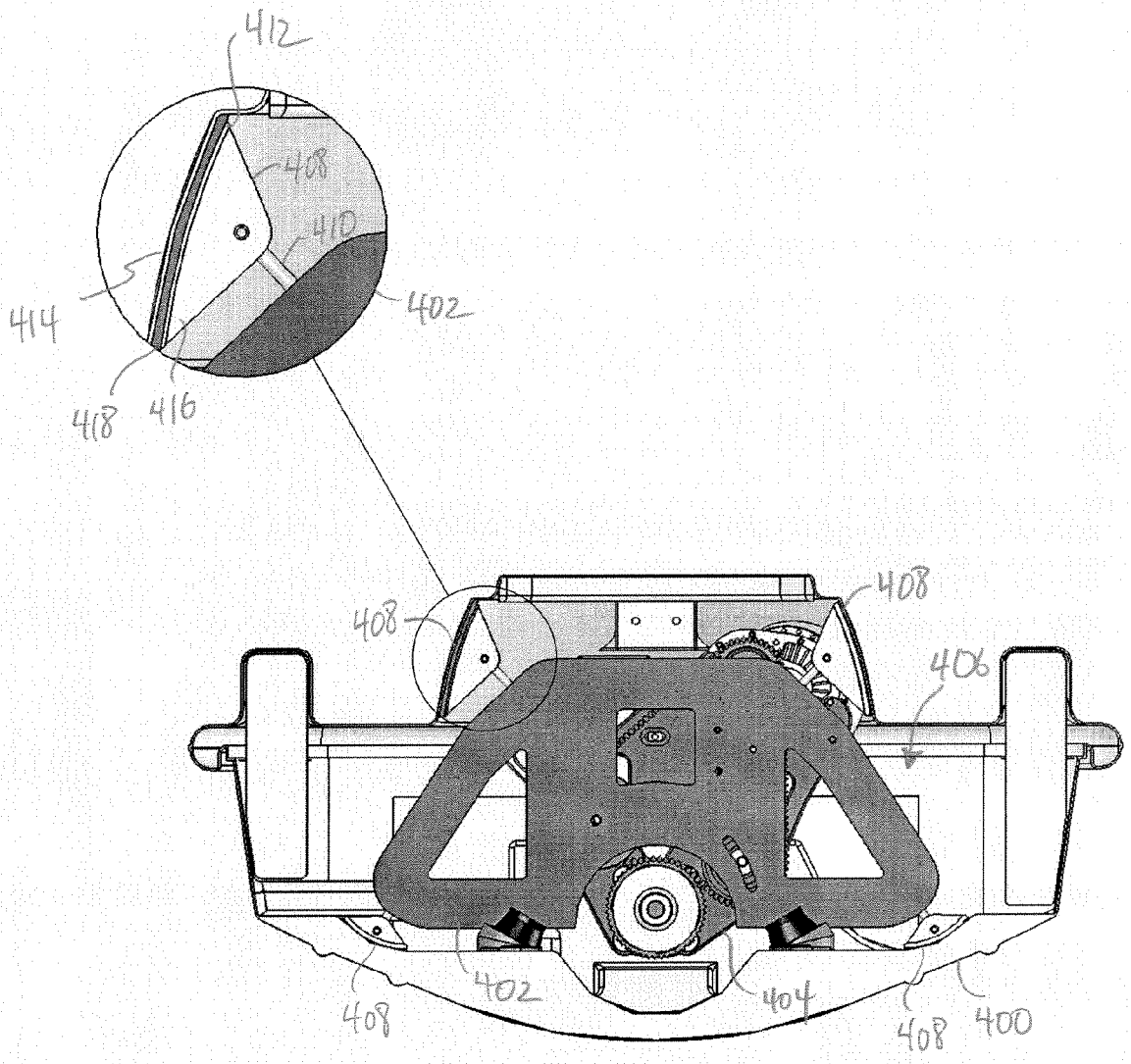
FIG. 14 is a vertical cross-sectional view of a personal watercraft constructed in accordance with an alternative embodiment of the present invention, particularly illustrating the alternative supercharger support structure of the forced air induction system.
Figure 15:
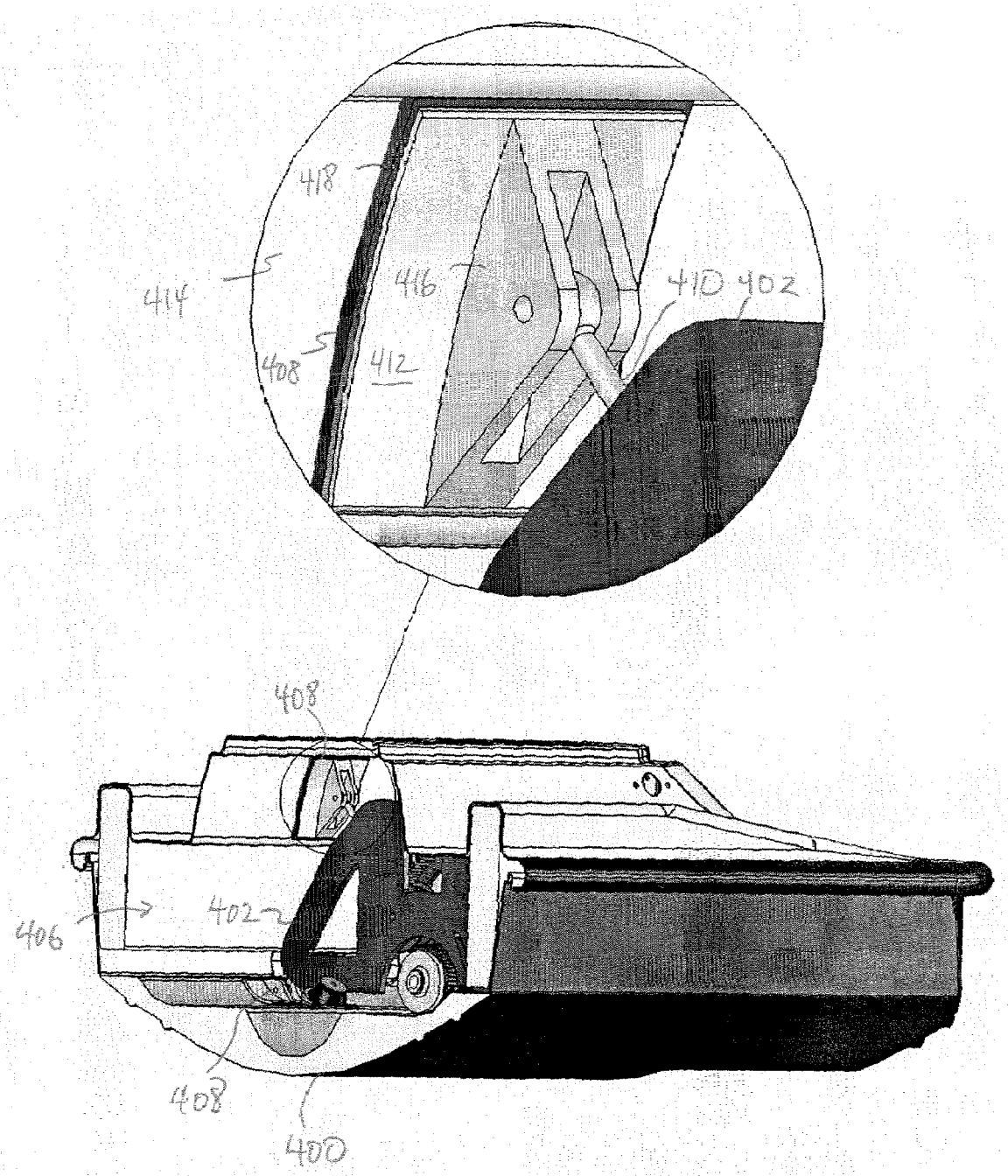
FIG. 15 is a perspective cross-sectional view of the personal watercraft depicted in FIG. 14.

The watercraft 400 depicted in FIGS. 14 and 15 includes a body-engaging bracket 402 and compressor bracket 404 that are fixed to one another and cooperatively constrained within the interior space 406 by pivotal body mounts 408 and adjustable connectors 410. The mounts 408 and connectors 410 are positioned in respective quadrants spaced about the interior space 406; that is, each mount includes a diametrically opposed mount and is spaced approximately ninety degrees (90°) from the adjacent mounts. In this manner, the connectors 410 are adjusted relative to the brackets 402 and 404 to generally place the brackets in compression and thereby constrain them in the desired location. In the illustrated embodiment, the body mounts 408 are arranged so that each diametrically opposed pair includes one connector on the body-engaging bracket 402 and one connector on the compressor bracket 404, although this arrangement is not critical. Furthermore, additional mounts and connectors may be provided if desired. As perhaps best shown in FIG. 15, each mount 408 includes plate 412 secured to the adjacent body wall 414 by fasteners (not shown). A compressible high-friction pad (preferably formed of elastomeric material) is compressed between the plate 412 and wall 414 to frictionally enhance the connection therebetween and cushion loads transferred from one side of the watercraft body to the other by the framework. Furthermore, the plate supports a clevis 416, which provides pivotal connection to the socket of the corresponding connector 410.

Figure 16:
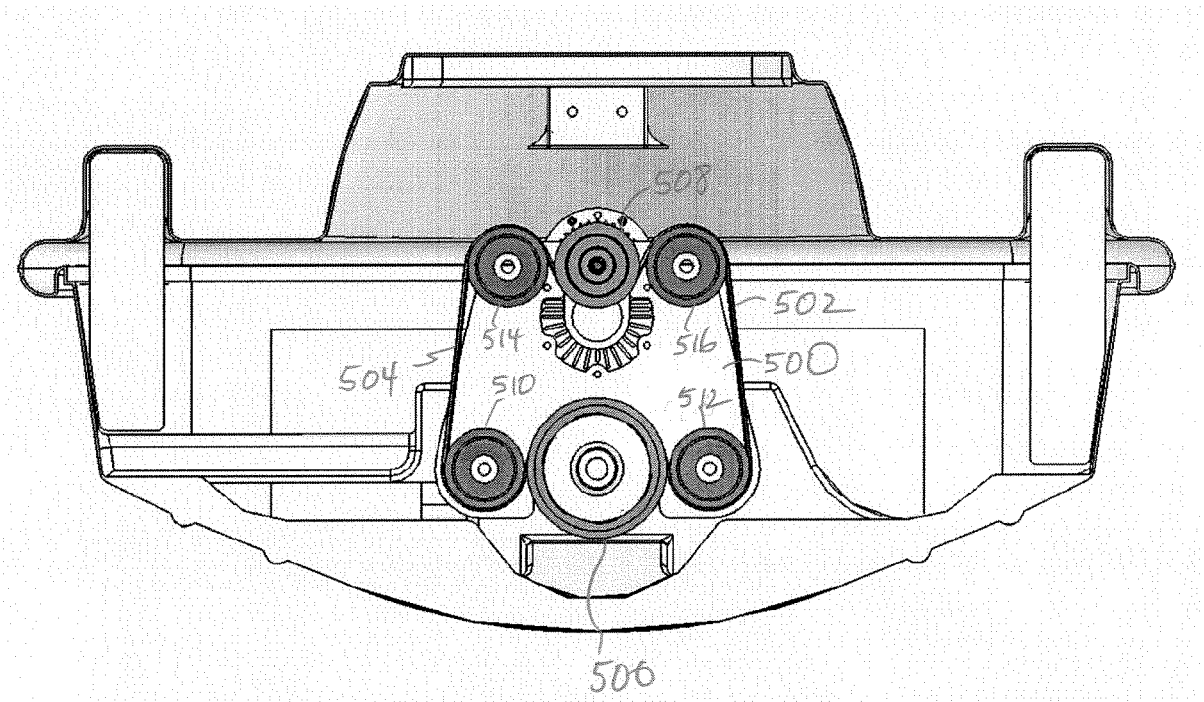
FIG. 16 is a vertical cross-sectional view of a personal watercraft constructed in accordance with an alternative embodiment of the present invention, particularly illustrating the alternative drive mechanism for the forced air induction system.
Figure 17:
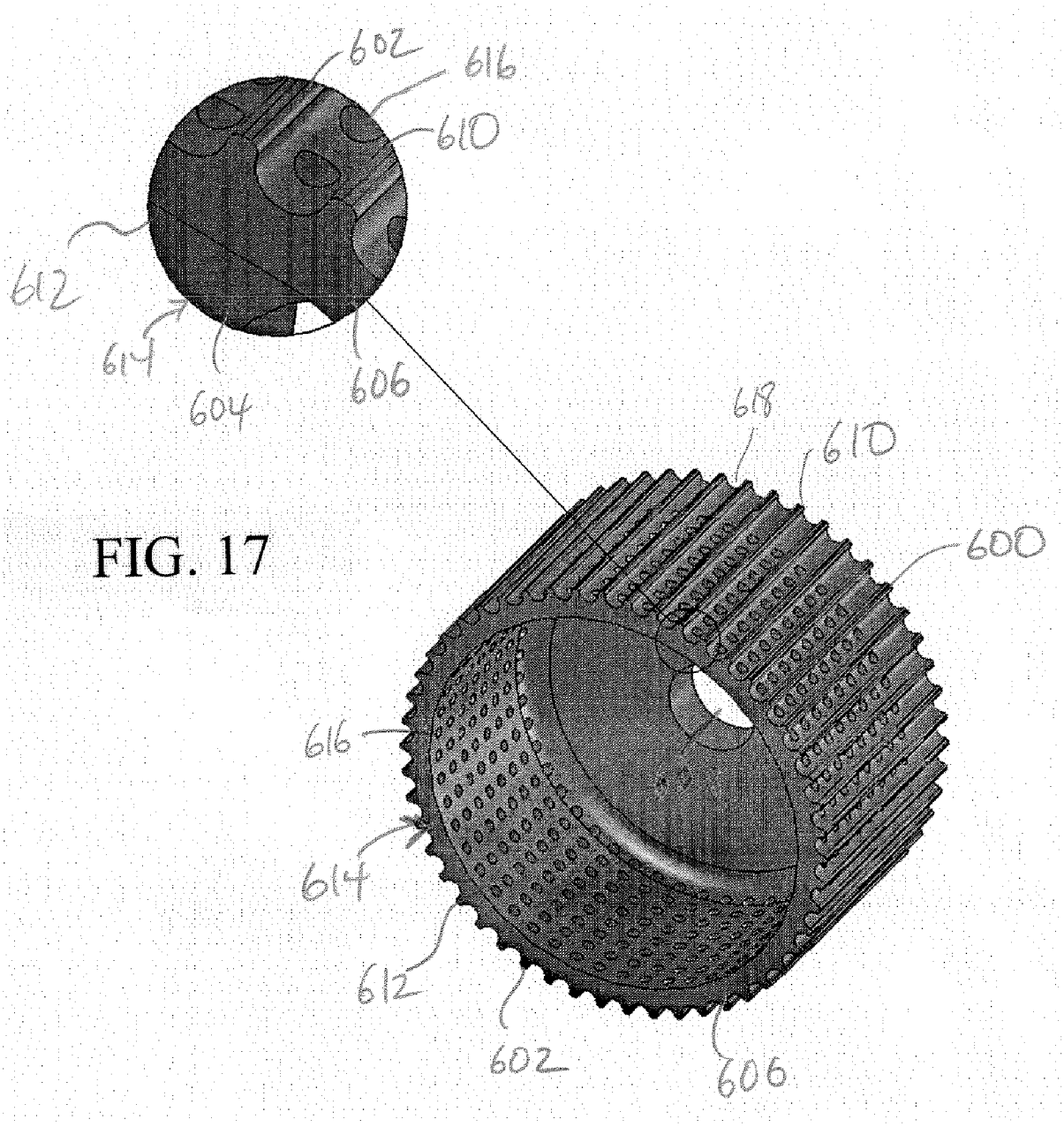
FIG. 17 is a perspective view of an alternative cogged driving pulley configured to relieve hydrodynamic forces between the pulley and belt.

According to the embodiment depicted in FIG. 16, a bracket 500 serves in part to support a drive mechanism 502 having a "double-backwrapped" belt 504. In particular, the belt 504 is backwrapped onto both the driving pulley 506 and driven pulley 508. It is noted that the illustrated belt 504 is a double-sided V-belt, with the outside surface thereof drivingly contacting the pulleys 506 and 508. A pair of idler pulleys 510,512 serve to maintain driving contact between the belt 504 and driving pulley 506, and a pair of idler pulleys 514,516 similarly maintain driving engagement between the belt 504 and driven pulley 508. The idler pulleys 510–518 are engaged by the inside surface of the belt 504. Such an arrangement further simplifies belt installation and replacement.

FIGS. 17–20 depict pulleys that are configured to relieve any hydrodynamic forces between the corresponding belt (not shown) and illustrated pulley. Those ordinarily skilled in the art will appreciate that water has a propensity to enter the engine room of the watercraft, even though every effort is made to seal the room from untoward leakage. Because belts traditionally have a continuous uninterrupted configuration (as opposed, for example, to a chain), any water between a conventional belt and pulley can be problematic. The illustrated pulley designs are particularly useful on the driving pulley; however, it is entirely within the ambit of the present invention to utilize these inventive concepts on other pulleys of the drive mechanism for the induction system (e.g., the driven pulley, idler pulley, etc.). The illustrated configurations also serve to reduce drive noise.

Turning specifically to the illustrated pulley designs, the driving pulley 600 is of the cogged variety and consequently includes a plurality of circumferentially spaced teeth 602. The pulley 600 preferably includes an end wall 604 and an annular wall 606 projecting axially from the end wall 604. The end wall 604 includes a central opening 608 which receives the driveshaft (not shown) therein, with the pulley 600 being suitably attached to the driveshaft. The annular wall presents an outer surface 610 about which the teeth 602 are spaced and an inner surface 612. The pulley 600 has a generally hollow configuration, with the inner surface 612 defining an internal cavity 614 that is laterally open at the side opposite from the end wall 604. Moreover, the pulley includes a plurality of fluid flow passageways that extend inwardly from the outer surface 610. The flow passageways preferably comprise a plurality of radial holes 616 extending between the surfaces 610 and 612. The holes 616 are preferably arranged within the axially extending spaces 618 defined between adjacent teeth 602. Particularly, the holes 616 are preferably spaced in rows located at the bottom of each space 618. The illustrated pulley 600 includes an equal number of uniformly spaced holes 616 in each axially extending space 618, although the principles of the present invention are equally applicable to a pulley having holes in only some of the spaces, unequal numbers of holes in adjacent spaces, holes located elsewhere within the spaces, etc. Those ordinarily skilled in the art will appreciate that fluid trapped between the belt and belt-engaging surface 610 is permitted to flow through one or more of the holes 616 and then be vented out of the cavity 614.

Figure 18:
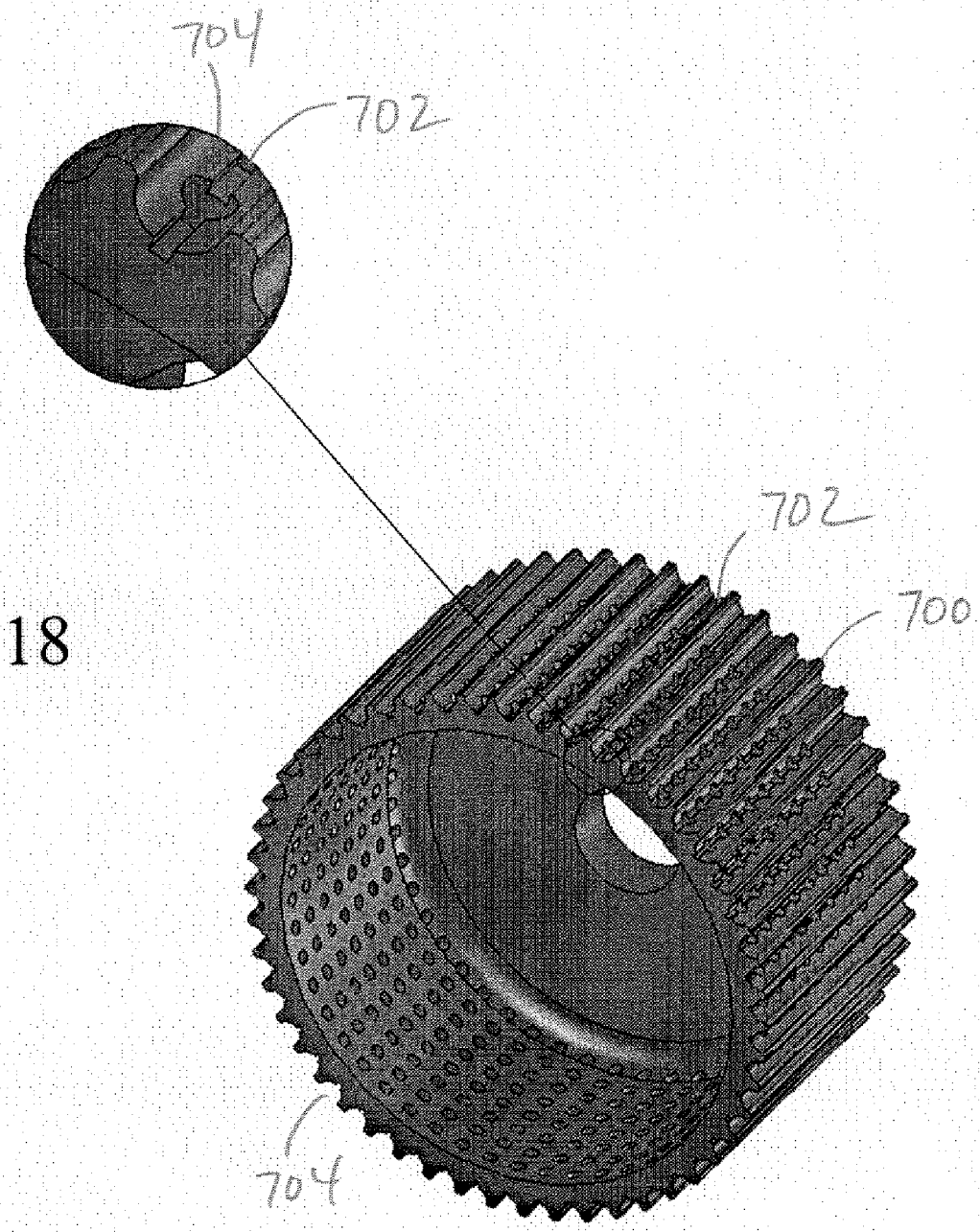
FIG. 18 is a perspective view of a second alternative cogged driving pulley arranged to relieve hydrodynamic forces between the pulley and belt.

The pulley 700 depicted in FIG. 18 is very similar to the pulley 600; however, the fluid flow passageway further includes an axially extending groove 702 defined along the bottom of each space 704. The pulley 600 and belt (not shown) are preferably configured so that the teeth of the belt remain substantially outside of the grooves 702 when received in the spaces. The grooves provide further relief for untoward hydrodynamic forces.

Figure 20:
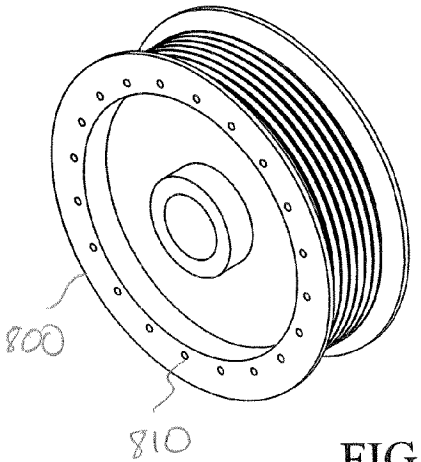
FIG. 20 is a perspective view of the pulley depicted in FIG. 19.
Figure 19:
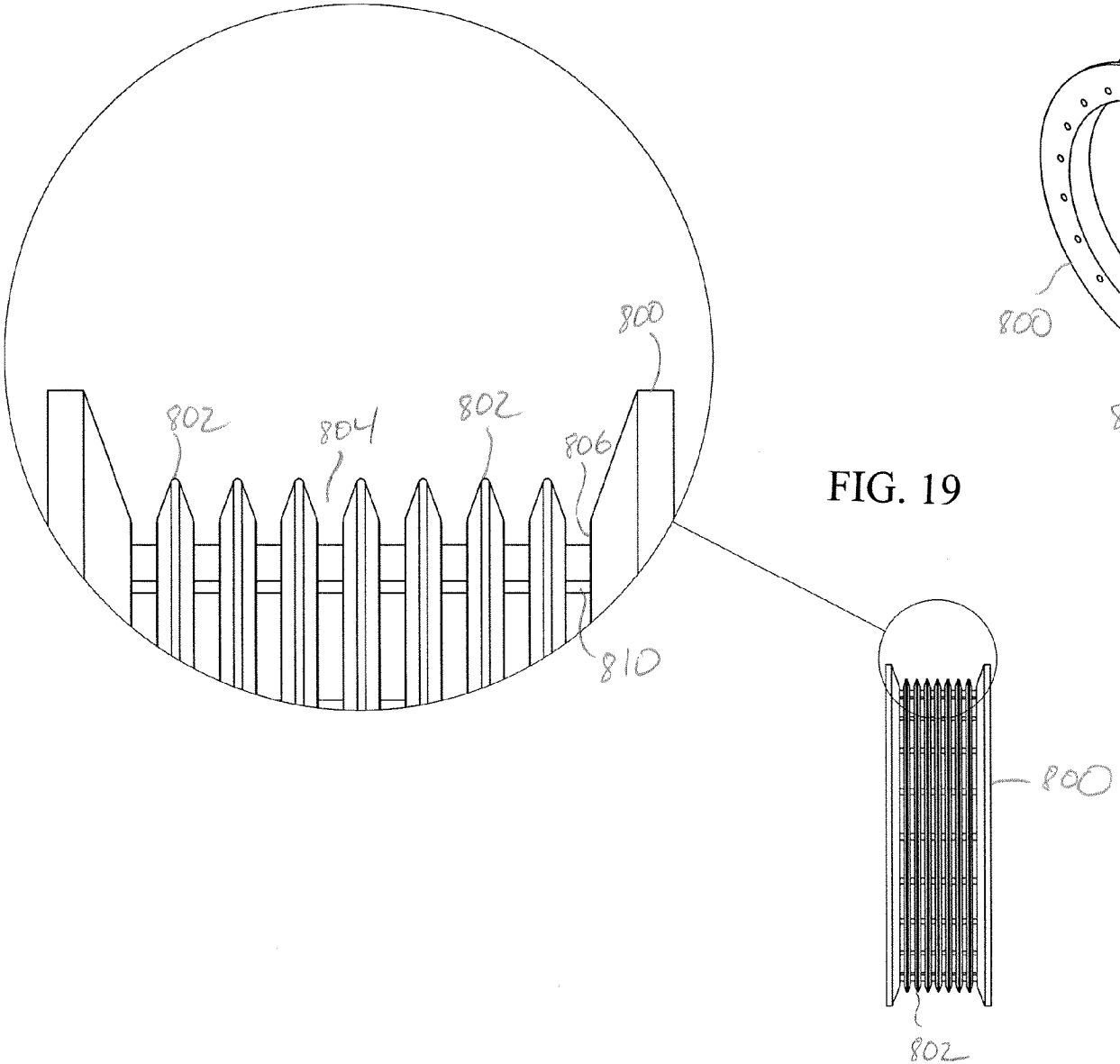
FIG. 19 is an elevation view of an alternative ribbed pulley arranged to relieve hydrodynamic forces between the pulley and belt.

A ribbed pulley 800 is depicted in FIGS. 19 and 20. The ribbed pulley 800 is particularly configured for use with a ribbed belt (not shown) and includes a plurality of axially spaced circumferential ribs 802 that define channels 804 between adjacent ones thereof. The fluid flow passageways comprise circumferential grooves 806, each of which extends inwardly from the bottom of a respective one of the channels 804. In the preferred embodiment, the belt and pulley 800 are cooperatively configured so that the ribs of the belt remain substantially outside of the grooves when the belt and pulley are engaged. A plurality of vent openings 810 are spaced below the channels 804. The vent openings 810 preferably extend completely through the pulley 800, although the principles of the present invention encompass an alternative vent opening that is open at only one side of the pulley. The illustrated vent openings 810 are preferably spaced about the circumference of the pulley 800 at positions that intersect with the grooves 806, whereby water within the grooves can be vented laterally through the openings 810.

Figure 8:
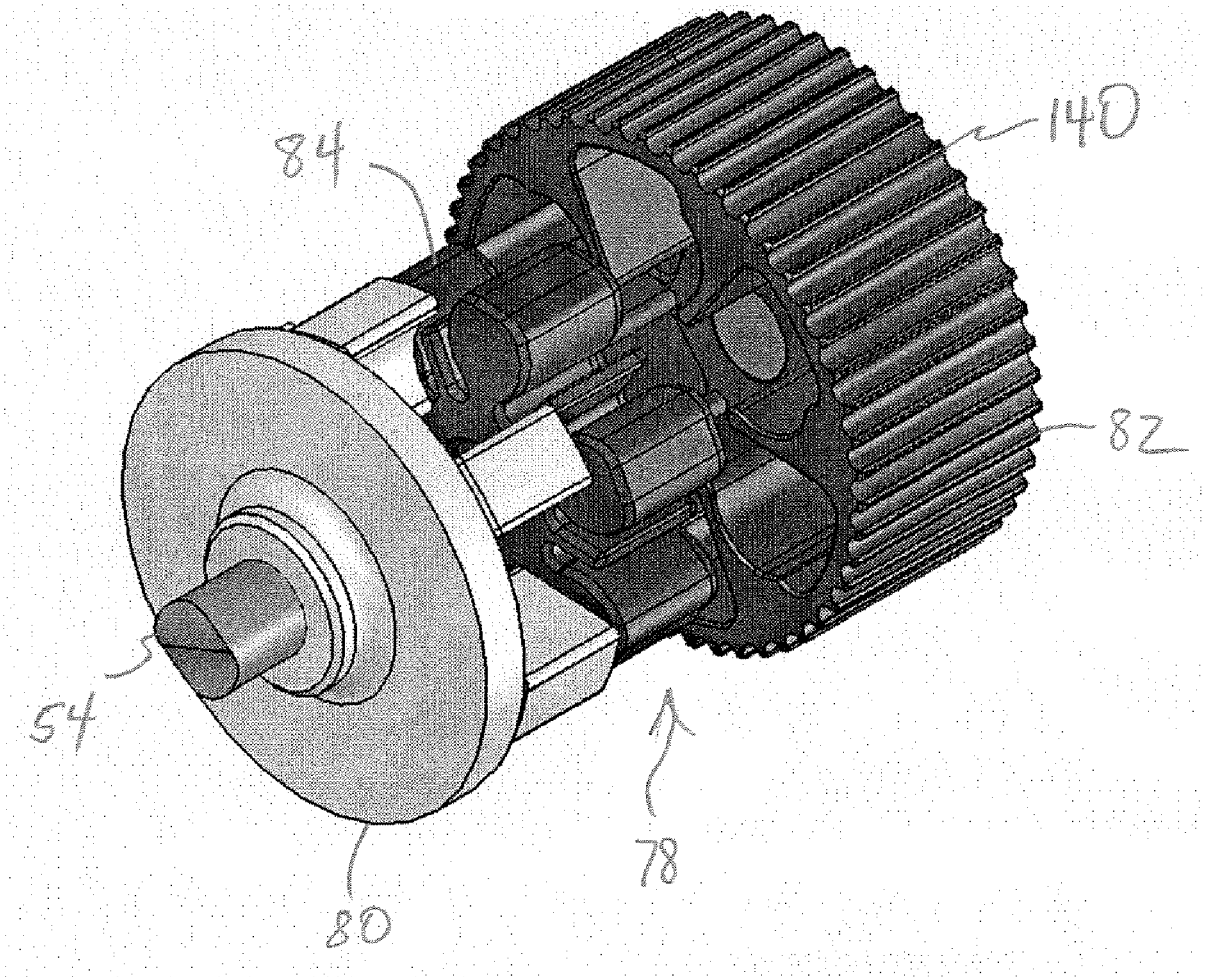
FIG. 8 is a perspective view of the driveshaft coupler of the driveline and the associated driving pulley of the drive mechanism for the induction system.
Figure 9:
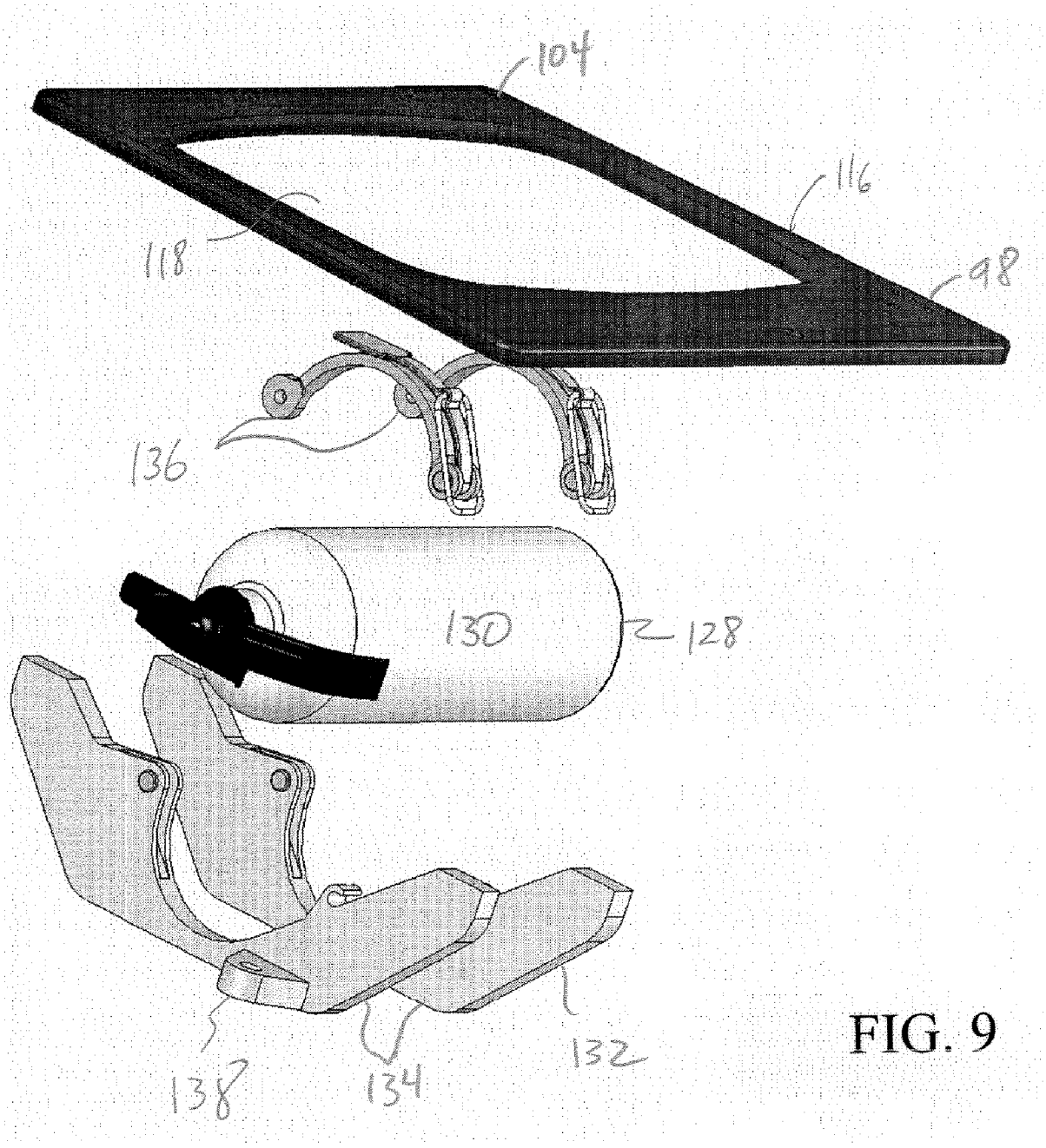
FIG. 9 is an exploded perspective view of part of the support frame of the induction system, the fire extinguisher, and fire extinguisher mount.
Figure 21:
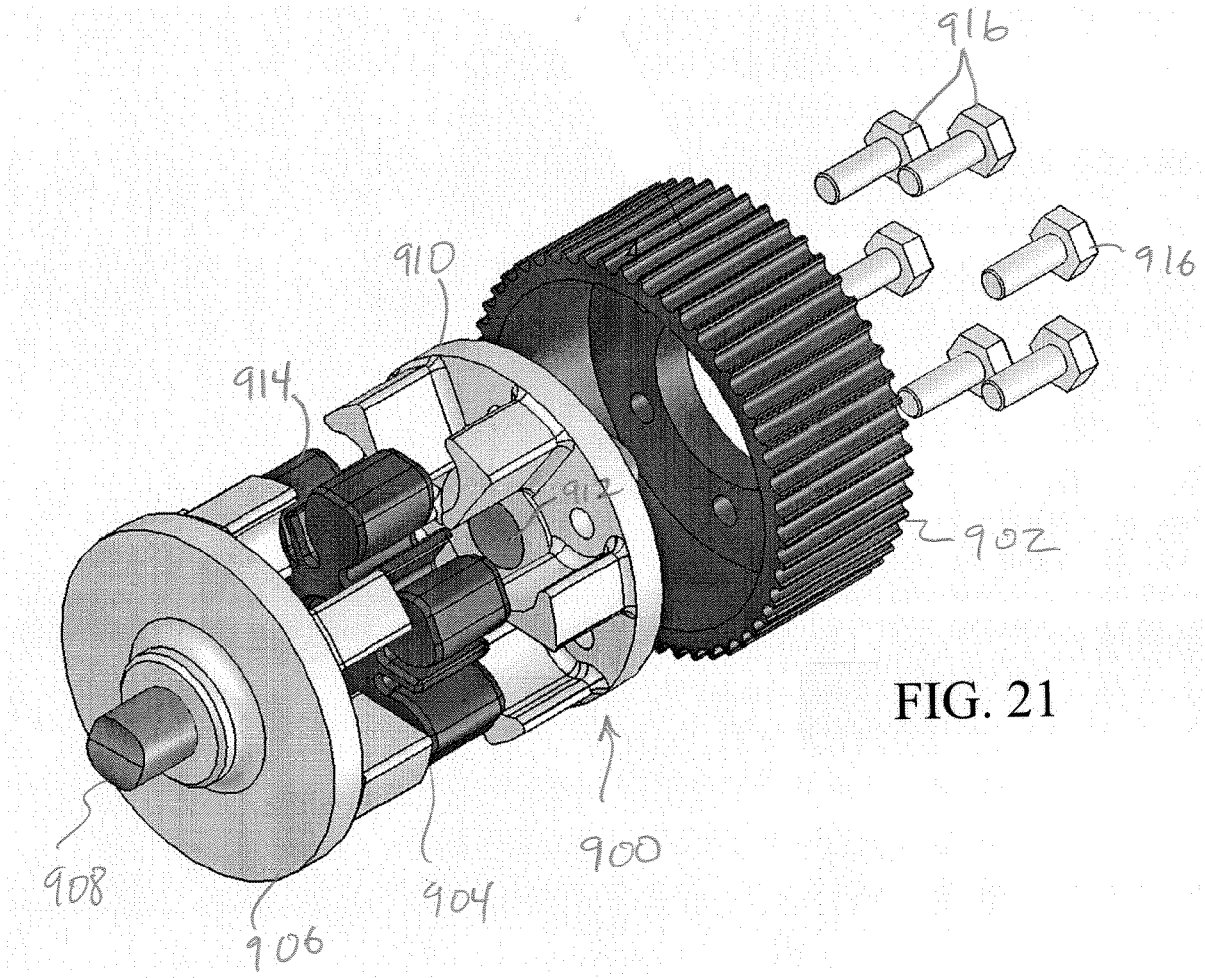
FIG. 21 is an exploded perspective view of an alternative driveshaft coupler and driving pulley arrangement, as compared to that depicted particularly in FIG. 8.

The coupler/driving pulley assembly 900 depicted in FIG. 21 is similar to that depicted specifically in FIG. 8; however, the pulley 902 and coupler 904 are not an integral component. Particularly, the coupler 904 similarly includes a driving component 906 fixed to the engine output shaft 908, a driven component 910 fixed to the driveshaft 912, and a compressible coupling component 914 interconnecting the components 906 and 910. However, the pulley 902 is separate from the driven component 910 and is removably attached thereto by fasteners 916.

The remaining pulley designs are directed to sectioned driving pulleys that are clamped to the shaft from which power for the supercharger is supplied. As before, the power-supplying shaft is preferably the driveshaft, although the principles of the present invention are equally applicable to other shafts extending between the engine and jet pump (e.g., the engine output shaft or crankshaft). In any case, a traditional pulley typically requires the power-supplying shaft to be removed so that the pulley can be slid over one end of the shaft. This process is difficult and time consuming. With the driving pulleys depicted in FIGS. 22–26, however, installation and replacement of the driving pulley can be accomplished without removal of the shaft. It is further noted that the embodiments depicted in FIGS. 22–24 utilize interference fits with the pulley being clamped directly to the underlying shaft. The inventive driving pulley typically has a shaft-receiving opening with a diameter that matches or is slightly undersized relative to the shaft diameter. FIGS. 25 and 26, on the other hand, depict driving pulleys using tapered bushing arrangements to connect to the shaft.

Figure 22:
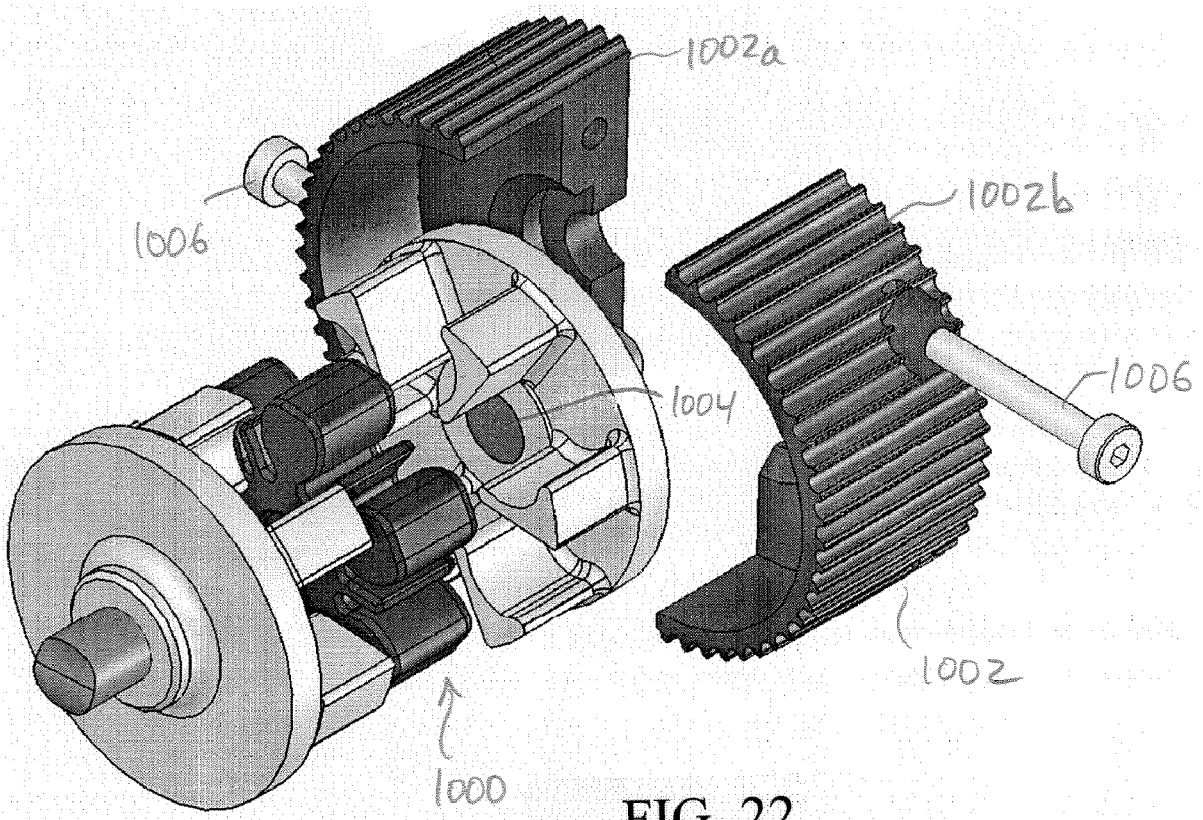
FIG. 22 is an exploded perspective view of an alternative driveshaft coupler and driving pulley arrangement, with the driving pulley being sectioned and clamped to the shaft.

The coupler/driving pulley assembly 1000 depicted in FIG. 22 is similar to the assembly 900. The primary distinction concerns the pulley 1002, which is sectioned into two equal halves 1002*a* and 1002*b*. The pulley segments 1002*a*,1002*b* cooperatively present a central opening for receiving the driveshaft 1004. The opening and shaft 1004 are dimensioned to provide an interference fit, such that the segments 1002*a*,1002*b* can be clamped onto the shaft 1004 and thereby firmly secured in place. In this regard, the pulley 1000 includes two threaded fasteners 1006 spaced on opposite sides of the central opening. The fasteners threadably engage opposite ones of the segments 1002*a*,1002*b* to equalize the clamping force. Although the illustrated pulley 1000 includes only two segments, it is entirely within the ambit of the present invention to have the pulley sectioned into more than two segments.

Figure 23:
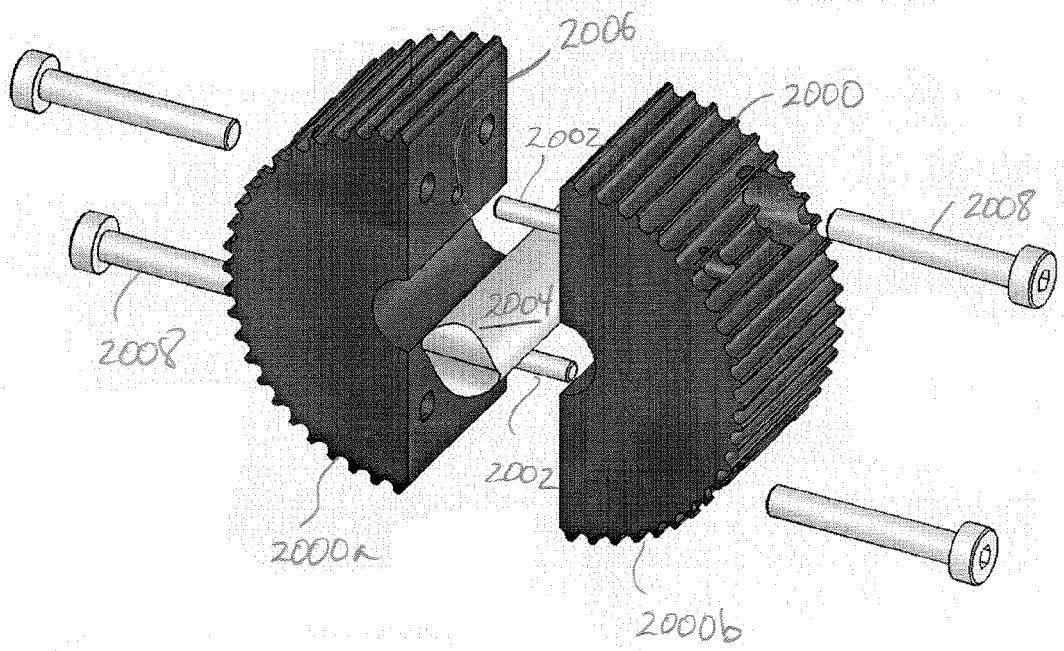
FIG. 23 is an exploded perspective view of an alternative driving pulley design, particularly illustrating the segments of the pulley before being clamped to the shaft.
Figure 24:
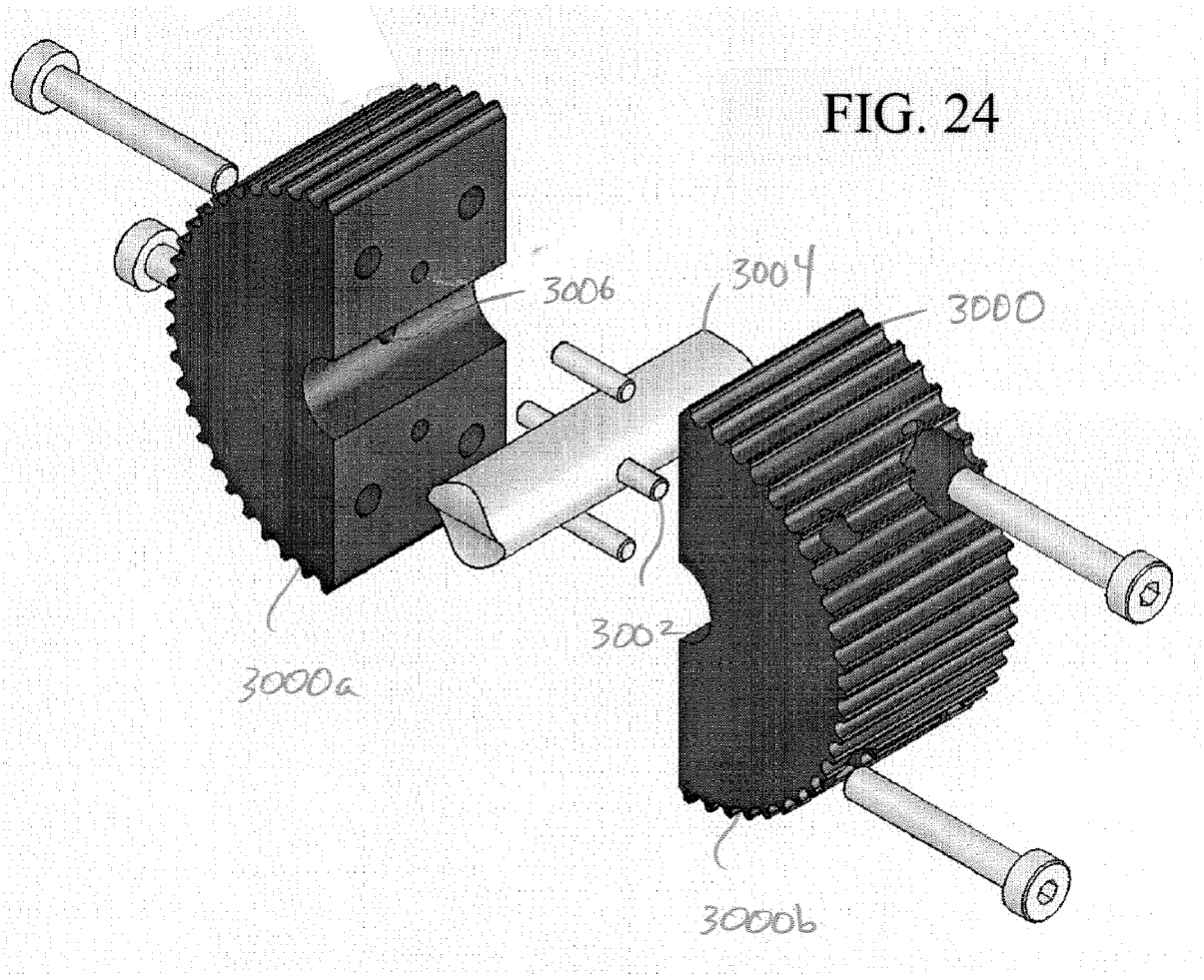
FIG. 24 is an exploded perspective view of an alternative driving pulley design similar to that depicted in FIG. 23.

The driving pulley 2000 depicted in FIG. 23 includes a pair of alignment pins 2002 spaced on opposite sides of the driveshaft 2004. The pins 2002 are received within respective aligned openings 2006 in the pulley segments 2000*a* and 2000*b*. The alignment pins 2002 serve to ensure proper positioning of the pulley segments 2000*a* and 2000*b* on the driveshaft 2004. It is also noted that the pulley 2000 has a generally solid configuration (relative to the pulley 1002) and four fasteners 2008, serving to interconnect the segments 2000*a* and 2000*b* and clamp them to the shaft 2004.

The driving pulley 3000 (shown in FIG. 24) is very similar to the pulley 2000, however a central alignment pin 3002 projects through the driveshaft 3004. The pin 3002 may be removably or fixedly connected to the shaft 3004. The pin 3002 is received within aligned openings 3006 in the pulley segments 3000*a* and 3000*b*.

As shown in FIG. 25, the driving pulley 4000 includes an inner tapered bushing 4002 and an outer cylindrical power-transmitting component 4004. The tapered bushing 4002 is preferably sectioned into segments 4002*a* and 4002*b*, although the bushing could alternatively (albeit less desirably) be a single piece bushing slid over the driveshaft 4006. The outer toothed component 4004 is similarly sectioned into equal-sized segments 4004*a* and 4004*b*; however, the principles of the present invention are equally applicable to a tapered bushing and outer component having an unequal number of segments and/or more than two segments each. The tapered bushing 4002 may be previously fixed to the shaft, but it is preferable to secure the tapered bushing 4002 using the clamping force created by the pulley 4000, as shown. In this regard, the tapered bushing 4002 and driveshaft 4006 provide an interference fit therebetween. The tapered bushing 4002 is provided with alignment pins 4008 spaced on opposite sides of the driveshaft 4006 and received in corresponding openings 4010 in the segments 4002*a* and 4002*b*. The outer power-transmitting component 4004 similarly includes alignment pins 4012, as well as threaded fasteners 4014 for preventing separation of the segments 4004*a* and 4004*b*. The outer bearing surface 4016 and the inner component surface 4018 are inclined relative to the driveshaft axis. Accordingly, as the surfaces 4016 and 4018 progressively interengage (caused by relative movement of the bushing 4002 and component 4004 in opposite directions along the shaft axis), a clamping force causes the bushing 4002 and component 4004 to be firmly secured to the driveshaft 4006. Such relative movement is controlled by threaded fasteners 4020. The fasteners 402 are parallel to the shaft axis. Moreover, the bushing 4002 includes threaded recesses 4022 which cooperate with threaded recesses 4024 in the outer component 4004 to define threaded openings for receiving the fasteners 4020. As the fasteners 4020 are threaded into and out of the openings, the bushing 4002 and component 4004 shift relative to one another to clamp or unclamp pulley 4000 relative to the driveshaft 4006.

As shown in FIG. 26, the driving pulley 5000 also utilizes a tapered bushing arrangement. It will be appreciated, however, that the segments of the outer power-transmitting component 5002 are not fastened to one another. Instead, the component 5002 is connected by six (6) fasteners 5004 to the tapered bushing 5006. The segments 5002*a*,5002*b* of the component 5002 and the segments 5006*a*,50006*b* are out of phase, meaning the dividing lines are not aligned. Thus, the segment 5002*a* is interconnected by the corresponding fasteners 5004 to both the bushing segments 5006*a* and 5006*b*.

The same may be said with respect to the component segment 5002*b*. As the fasteners 5004 are tightened, the cam surfaces of the component 5002 and bushing 5006 progressively interengage to clamp the pulley 5000 on the shaft 5008, while preventing the component segments 5002*a* and 5002*b* from separating.

Those ordinarily skilled in the art will appreciate that the principles of the present invention encompass various combinations of the illustrated embodiments. For example, one preferred embodiment of the present invention involves an induction system similar to that depicted in FIGS. 1–9, but utilizing a sectioned driving pulley with fluid flow passageways for relieving hydrodynamic forces.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A personal watercraft comprising:

a body configured to support at least one rider, with the body defining an interior space;

an engine contained within the body; and a forced air induction system operable to pressurize intake fluid and deliver the pressurized fluid to the engine, said induction system including— a compressor including a case in which intake fluid is pressurized when the compressor is powered, and support structure separate from the engine and coupled to the case to support the compressor on the body within the interior space, said support structure being attached to the body at spaced apart attachment locations, at least two of which are situated on the body so that part of the interior space is defined therebetween, said support structure supporting the compressor between said at least two attachment locations so as to provide non-cantilevered support of the compressor.

2. The personal watercraft as claimed in claim 1, said compressor being spaced from the engine.

3. The personal watercraft as claimed in claim 1, said compressor being positioned between said at least two attachment locations so as to be within said part of the interior space.

4. The personal watercraft as claimed in claim 3, said support structure including a frame extending across the interior space, with said at least two attachment locations being generally opposed on the body, said compressor being located on the frame at a position spaced between the at least two attachment locations.

5. The personal watercraft as claimed in claim 1, said interior space comprising an engine room, in which both the engine and the induction system are located.

6. The personal watercraft as claimed in claim 1, said body including a hull and a deck which cooperatively define the interior space, said deck presenting a seat on which the at least one rider sits astride.

7. The personal watercraft as claimed in claim 1, said support structure including a frame shiftably attached to the body at a first one of the attachment locations.

8. The personal watercraft as claimed in claim 7, said frame including an adjustable length connector that is associated with the first one of the attachment locations and extends between the body and a corresponding connection part of the frame.

9. The personal watercraft as claimed in claim 1, said support structure including a frame, said frame including a body-mounting bracket attached to the body and a compressor bracket fixed to the body-mounting bracket, said compressor being mounted on the compressor bracket.

10. The personal watercraft as claimed in claim 9, said compressor comprising a supercharger that includes an input shaft, said forced air induction system including a drive mechanism configured to supply power from the engine to the input shaft of the supercharger, said drive mechanism being located between the brackets.

11. The personal watercraft as claimed in claim 9; and a plurality of spaced apart engine mounts securing the engine to the body, said body-mounting bracket being coupled to at least two of the engine mounts and thereby attached to the body.

12. The personal watercraft as claimed in claim 11, said frame including a brace plate attached to the body, with the compressor being pivotally coupled to the brace plate.

13. The personal watercraft as claimed in claim 12, said brace plate extending alongside the body, said support structure including a pad of high-friction material between the plate and body for frictionally enhancing the connection between the plate and body.

14. The personal watercraft as claimed in claim 12; and a fire extinguisher, said frame including a fire extinguisher mount fixed to the brace plate, said fire extinguisher mount removably supporting the fire extinguisher within the interior space.

15. The personal watercraft as claimed in claim 11, said support structure including at least one pivotal body mount, said compressor bracket being coupled to the body mount such that the compressor is shiftably attached to the body by the at least one body mount.

16. The personal watercraft as claimed in claim 15, said frame including a Y-shaped bracket presenting a stem and a pair of aims, with the stem being fixed to the compressor bracket and each of the arms being attached to the body by one of the pivotal body mounts.

17. The personal watercraft as claimed in claim 15, said frame including an adjustable length connector connected between the compressor bracket and the at least one pivotal body mount.

18. The personal watercraft as claimed in claim 1, said support structure including a plurality of pivotal body mounts, each corresponding with one of the attachment locations, said support structure further including a frame that includes a plurality of adjustable length connectors, each being associated with a respective one of the body mounts, said attachment locations being arranged in at least two angularly offset pairs, with each of the pairs having a generally diametric arrangement within the interior space of the body.

19. The personal watercraft as claimed in claim 18, said frame including a body-mounting bracket attached to the body and a compressor bracket fixed to the body-mounting bracket, said compressor being mounted on the compressor bracket, one of the connectors of each pair being connected to the compressor bracket and the other of the connectors of each pair connected to the body-mounting bracket.

20. The personal watercraft as claimed in claim 1, said support structure including a body-engaging plate that extends alongside the body and is secured thereto, said support structure including a pad of high-friction material between the plate and body for frictionally enhancing the connection between the plate and body.

21. The personal watercraft as claimed in claim 1;

a water jet pump adjacent the stem of the body; and a driveline drivingly connecting the jet pump to the engine, with the driveline including a rotatable shaft, said compressor comprising a supercharger including a rotatable input shaft, said induction system including a drive mechanism configured to supply power from the engine to the input shaft of the supercharger, said drive mechanism including a driving member fixed to the shaft, a driven member fixed to the input shaft, at least one rotatable idler member, and an endless element entraining the members, said endless element presenting opposite member engaging surfaces, an outer one of which engages the driving member and an inner one of which engages the idler member.

22. The personal watercraft as claimed in claim 21, said shaft extending between the engine and jet pump, said driving member being sectioned into a plurality of segments that are interconnected and fixed to the shaft, such that the driving member can be fixed to the shaft without having to remove the shaft.

23. The personal watercraft as claimed in claim 22, said members each comprising a pulley, said endless element comprising a belt entraining the pulleys, at least one of said pulleys presenting a belt-engaging surface and a recessed fluid flow passageway extending inwardly from the belt-engaging surface to relieve hydrodynamic forces between said at least one of the pulleys and the belt.

24. The personal watercraft as claimed in claim 1;

a water jet pump adjacent the stern of the body; and a driveline drivingly connecting the jet pump to the engine, with the driveline including a rotatable shaft extending between the engine and jet pump, said compressor comprising a supercharger including a rotatable input shaft, said induction system including a drive mechanism configured to supply power from the engine to the input shaft of the supercharger, said drive mechanism including a driving member fixed to the shaft and a driven member fixed to the input shaft, with the members being drivingly interconnected, said driving member being sectioned into a plurality of segments that are interconnected and fixed to the shaft, such that the driving member can be fixed to the shaft without having to remove the shaft.

25. The personal watercraft as claimed in claim 1;

a water jet pump adjacent the stern of the body; and a driveline drivingly connecting the jet pump to the engine, with the driveline including a rotatable shaft, said compressor comprising a supercharger including a rotatable input shaft, said induction system including a drive mechanism configured to supply power from the engine to the input shaft of the supercharger, said drive mechanism including a driving pulley fixed to the shaft, a driven pulley fixed to the input shaft, and an endless belt entraining the pulleys, at least one of said pulleys presenting a belt-engaging surface and a recessed fluid flow passageway extending inwardly from the belt-engaging surface to relieve hydrodynamic forces between said at least one of the pulleys and the belt.

26. A personal watercraft comprising:

a body configured to support at least one rider;

an engine contained within the body;

a water jet pump adjacent the stern of the body;

a driveline drivingly connecting the jet pump to the engine, with the driveline including a rotatable shaft; and a forced air induction system operable to supercharge intake fluid and deliver the supercharged fluid to the engine, said induction system including— a supercharger including a rotatable input shaft, and a drive mechanism configured to supply power from the engine to the input shaft of the supercharger, said drive mechanism including a driving member fixed to the shaft, a driven member fixed to the input shaft, at least one rotatable idler member associated with the driving member, and an endless element entraining the members, said endless element presenting opposite member engaging surfaces, an outer one of which engages the driving member and an inner one of which engages the at least one idler member.

27. The personal watercraft as claimed in claim 26, said shaft extending between the engine and jet pump.

28. The personal watercraft as claimed in claim 26, said endless element comprising a double-sided cog belt, said members each presenting an outer cogged surface.

29. The personal watercraft as claimed in claim 26, said drive mechanism including a pair of idler members associated with the driving member, said pair of idler members cooperatively maintaining the endless element in driving contact with the driving member.

30. The personal watercraft as claimed in claim 29, said supercharger including a case in which intake fluid is pressurized when the compressor is powered, said induction system including a support frame coupled to the case to support the supercharger on the body, at least one of said idler members being adjustably supported on the frame.

31. The personal watercraft as claimed in claim 26, said inner surface of said endless element engaging the driven member.

32. The personal watercraft as claimed in claim 26, said outer surface of said endless element engaging the driven member, said drive mechanism including at least one idler member associated with the driven member, said inner surface of the endless element engaging the idler members.

33. The personal watercraft as claimed in claim 26, said shaft extending between the engine and jet pump, said driving member being sectioned into a plurality of segments that are interconnected and fixed to the shaft, such that the driving member can be fixed to the shaft without having to remove the shaft.

34. The personal watercraft as claimed in claim 33, said driving member including a cylindrical power-transmitting component presenting an outer component surface engaged by the endless element, said component being sectioned to present a plurality of component segments.

35. The personal watercraft as claimed in claim 34, said shaft presenting an outer shaft surface, said power-transmitting component presenting an radially inner component surface engaging the shaft outer surface, said component including a plurality of fasteners interconnecting the component segments and serving to clamp the component on the shaft.

36. The personal watercraft as claimed in claim 34, said driving member including a tapered bushing, said bushing being sectioned to present a plurality of bushing segments, said bushing presenting an outer bushing surface, said component presenting an inner component surface, said outer bushing surface and said inner component surface being inclined relative to the shaft axis, said driving member being configured to permit progressive interengagement between the outer bushing surface and the inner component surface and thereby interconnect the component and bushing.

37. The personal watercraft as claimed in claim 33, said members each comprising a pulley, said endless element comprising a belt entraining the pulleys, at least one of said pulleys presenting a belt-engaging surface and a recessed fluid flow passageway extending inwardly from the belt-engaging surface to relieve hydrodynamic forces between said at least one of the pulleys and the belt.

38. The personal watercraft as claimed in claim 26, said members each comprising a pulley, said endless element comprising a belt entraining the pulleys, at least one of said pulleys presenting a belt-engaging surface and a recessed fluid flow passageway extending inwardly from the belt-engaging surface to relieve hydrodynamic forces between said at least one of the pulleys and the belt.

39. The personal watercraft as claimed in claim 26, said supercharger including a case in which intake fluid is pressurized when the compressor is powered, said induction system including support structure coupled to the case to support the supercharger on the body, said support structure including a body-engaging plate that extends alongside the body and is secured thereto, said support structure including a pad of high-friction material between the plate and body for frictionally enhancing the connection between the plate and body.

40. A personal watercraft comprising:

a body configured to support at least one rider;

an engine contained within the body;

a water jet pump adjacent the stem of the body;

a driveline drivingly connecting the jet pump to the engine, with the driveline including a rotatable shaft extending between the engine and jet pump; and a forced air induction system operable to supercharge intake fluid and deliver the supercharged fluid to the engine, said induction system including— a supercharger including a rotatable input shaft, and a drive mechanism configured to supply power from the engine to the input shaft of the supercharger, said drive mechanism including a driving member fixed to the shaft and a driven member fixed to the input shaft, with the members being drivingly interconnected, said driving member being sectioned into a plurality of segments that are interconnected and fixed to the shaft, such that the driving member can be fixed to the shaft without having to remove the shaft.

41. The personal watercraft as claimed in claim 40, said drive mechanism including an endless element entraining the members.

42. The personal watercraft as claimed in claim 41, said driving and driven members each comprising a pulley, said endless element comprising a belt entraining the pulleys, at least one of said pulleys presenting a belt-engaging surface and a recessed fluid flow passageway extending inwardly from the belt-engaging surface to relieve hydrodynamic forces between said at least one of the pulleys and the belt.

43. The personal watercraft as claimed in claim 40, said driving member including a cylindrical power-transmitting component presenting an outer component surface configured to transmit power from the shaft to the driven member, said component being sectioned to present a plurality of component segments.

44. The personal watercraft as claimed in claim 43, said shaft presenting an outer shaft surface, said power-transmitting component presenting an radially inner component surface engaging the shaft outer surface, said component including a plurality of fasteners interconnecting the component segments and serving to clamp the component on the shaft.

45. The personal watercraft as claimed in claim 44, said component including at least one alignment pin extending into corresponding ones of the component segments.

46. The personal watercraft as claimed in claim 44, said driving member including at least one alignment pin projecting from the shaft and into the component segments.

47. The personal watercraft as claimed in claim 43, said driving member including a tapered bushing, said bushing being sectioned to present a plurality of bushing segments, said bushing presenting an outer bushing surface, said component presenting an inner component surface, said outer bushing surface and said inner component surface being inclined relative to the shaft axis, said driving member being configured to permit progressive interengagement between the outer bushing surface and the inner component surface and thereby interconnect the component and bushing.

48. The personal watercraft as claimed in claim 47,
said driving member including a plurality of fasteners threadably engaging the component and bushing so as to cause relative shifting therebetween when the fasteners are threaded and unthreaded.

49. The personal watercraft as claimed in claim 48,
said bushing and said component each including at least one alignment pin extending into corresponding ones of the segments thereof.

50. The personal watercraft as claimed in claim 40,
said supercharger including a case in which intake fluid is pressurized when the compressor is powered,
said induction system including support structure coupled to the case to support the supercharger on the body,
said support structure including a body-engaging plate that extends alongside the body and is secured thereto,
said support structure including a pad of high-friction material between the plate and body for frictionally enhancing the connection between the plate and body.

51. A personal watercraft comprising:
a body configured to support at least one rider;
an engine contained within the body;
a water jet pump adjacent the stern of the body;
a driveline drivingly connecting the jet pump to the engine, with the driveline including a rotatable shaft; and
a forced air induction system operable to supercharge intake fluid and deliver the supercharged fluid to the engine, said induction system including—
a supercharger including a rotatable input shaft, and
a drive mechanism configured to supply power from the engine to the input shaft of the supercharger,
said drive mechanism including a driving pulley fixed to the shaft, a driven pulley fixed to the input shaft, and an endless belt entraining the pulleys,
at least one of said pulleys presenting a belt-engaging surface and a recessed fluid flow passageway extending inwardly from the belt-engaging surface to relieve hydrodynamic forces between said at least one of the pulleys and the belt.

52. The personal watercraft as claimed in claim 51,
said at least one pulley being the driving pulley.

53. The personal watercraft as claimed in claim 51,
said at least one pulley including a fluid vent spaced from the belt-engaging surface, with
said vent being configured to vent fluid in a direction parallel to an axis of the pulley,
said passageway fluidly communicating with the vent.

54. The personal watercraft as claimed in claim 53,
said at least one pulley presenting a laterally open internal cavity spaced radially inward from the belt-engaging surface,
said cavity defining the fluid vent.

55. The personal watercraft as claimed in claim 54,
said at least one pulley including an annular wall, an outer surface of which presents the belt-engaging surface and an inner surface of which at least partly defines the internal cavity.

56. The personal watercraft as claimed in claim 55,
said passageway comprising a plurality of holes extending between the surfaces of the annular wall.

57. The personal watercraft as claimed in claim 56,
said belt and said at least one pulley being toothed such that each present axially extending spaces defined between adjacent teeth and configured to receive one of teeth of the other,
said holes each being located within a corresponding one of the spaces of the at least one pulley.

58. The personal watercraft as claimed in claim 57,
said spaces of the at least one pulley each including a plurality of the holes spaced axially along the length thereof.

59. The personal watercraft as claimed in claim 57,
said passageway further comprising an axially extending groove that projects inwardly from each space and is open at opposite sides of the at least one pulley,
said belt and said at least one pulley being configured so that the teeth of the belt remain substantially outside of the grooves when received in the spaces.

60. The personal watercraft as claimed in claim 53,
said passageway comprising a plurality of holes extending inwardly from the belt-engaging surface to the vent.

61. The personal watercraft as claimed in claim 60,
said belt and said at least one pulley being toothed such that each present axially extending spaces defined between adjacent teeth and configured to receive one of teeth of the other,
said holes each being located within a corresponding one of the spaces of the at least one pulley.

62. The personal watercraft as claimed in claim 61,
said spaces of the at least one pulley each including a plurality of the holes spaced axially along the length thereof.

63. The personal watercraft as claimed in claim 61,
said passageway further comprising an axially extending groove that projects inwardly from each space and is open at opposite sides of the at least one pulley,
said belt and said at least one pulley being configured so that the teeth of the belt remain substantially outside of the grooves when received in the spaces.

64. The personal watercraft as claimed in claim 53,
said at least one pulley including a plurality of axially spaced ribs extending about the circumference thereof, such that a circumferential channel is defined between adjacent ones of the ribs,
said passageway comprising a circumferentially extending groove that projects inwardly from the channel,
said belt and said at least one pulley being configured so that the belt remains substantially outside of the grooves when drivingly contacting the belt-engaging surface.

65. The personal watercraft as claimed in claim 64,
said at least one pulley including a plurality of circumferentially spaced openings projecting axially from at least one side of the at least one pulley,
said vent being defined by the openings, such that the grooves and openings are fluidly interconnected.

66. The personal watercraft as claimed in claim 51,
said belt and said at least one pulley being toothed such that each present axially extending spaces defined between adjacent teeth and configured to receive one of teeth of the other,
said passageway comprising an axially extending groove that projects inwardly from each space and is open at opposite sides of the at least one pulley,
said belt and said at least one pulley being configured so that the teeth of the belt remain substantially outside of the grooves when received in the spaces.

67. The personal watercraft as claimed in claim 51,
said supercharger including a case in which intake fluid is pressurized when the compressor is powered,
said induction system including support structure coupled to the case to support the supercharger on the body, said support structure including a body-engaging plate that extends alongside the body and is secured thereto, said support structure including a pad of high-friction material between the plate and body for frictionally enhancing the connection between the plate and body.

68. A personal watercraft comprising:

a body configured to support at least one rider, with the body defining an interior space;

an engine contained within the body; and a forced air induction system operable to pressurize intake fluid and deliver the pressurized fluid to the engine, said induction system including— a compressor including a case in which intake fluid is pressurized when the compressor is powered, support stricture coupled to the case to support the compressor on the body within the interior space, said support structure including a body-engaging plate that extends alongside the body and is secured thereto, said support structure including a pad of high-friction material between the plate and body for frictionally enhancing the connection between the plate and body.

69. The personal watercraft as claimed in claim 68, said support structure including a frame on which the compressor is mounted, said body-engaging plate comprising a brace plate of the frame.

70. The personal watercraft as claimed in claim 69, said compressor being pivotally attached to the brace plate.

71. The personal watercraft as claimed in claim 69, said body including a hull and a deck cooperatively defining an interior space in which the engine and induction system are contained, said deck presenting a seat on which the at least one rider sits astride, said seat removably covering an access opening to the interior space, said brace plate being adjacent the access opening.

72. The personal watercraft as claimed in claim 68, said support structure including at least one body mount serving to attach the support structure to the body, said body-engaging plate forming part of the body mount.

73. The personal watercraft as claimed in claim 72, said support structure including a frame on which the compressor is mounted, said frame being coupled to the body mount.

74. The personal watercraft as claimed in claim 73, said body mount including a clevis projecting from the plate, said frame including a connector pivotally coupled to the clevis.

75. The personal watercraft as claimed in claim 68, said pad being formed of a compressible material, said support structure including fasteners for securing the body-engaging plate to the body, said fasteners being tightened so that pad is resiliently compressed when the plate is secured to the body.

76. The personal watercraft as claimed in claim 68, said high-friction material comprising an elastomeric material.

77. The personal watercraft as claimed in claim 76, said elastomeric material being selected from the group consisting of vinyl rubber, buna rubber, and neoprene.

78. A personal watercraft comprising:

a body configured to support at least one rider, with the body defining an interior space;

an engine contained within the body;

a fire extinguisher; and a forced air induction system operable to pressurize intake fluid and deliver the pressurized fluid to the engine, said induction system including— a compressor including a case in which intake fluid is pressurized when the compressor is powered, a support frame coupled to the case to support the compressor on the body within the interior space, said support frame including a fire extinguisher mount that removably supports the fire extinguisher within the interior space.

79. The personal watercraft as claimed in claim 78, said mount including an upwardly open cradle in which the fire extinguisher rests, said mount further including a clamp mechanism configured to releasably secure the fire extinguisher within the cradle.

80. The personal watercraft as claimed in claim 79, said body including a hull and a deck cooperatively defining an interior space in which the engine, fire extinguisher, and induction system are contained.

said deck presenting a seat on which the at least one rider sits astride, said seat removably covering an access opening to the interior space.

81. The personal watercraft as claimed in claim 80, said frame including a brace plate extending alongside the body adjacent the access opening, said brace plate being secured to the body and the compressor being coupled to the brace plate, said brace plate presenting a central opening configured to receive the fire extinguisher therein.

82. The personal watercraft as claimed in claim 81, said cradle extending across the central opening of the brace plate and configured to support the fire extinguisher below the central opening.

83. The personal watercraft as claimed in claim 78, said body defining an interior space, said frame being attached to the body at spaced apart attachment locations, at least two of which are situated on the body so that part of the interior space is defined therebetween, said frame supporting the compressor between said at least two attachment locations so as to provide non-cantilevered support of the compressor.

84. The personal watercraft as claimed in claim 78;

a water jet pump adjacent the stern of the body; and a driveline drivingly connecting the jet pump to the engine, with the driveline including a rotatable shaft extending between the engine and jet pump, said compressor comprising a supercharger including a rotatable input shaft, said induction system including a drive mechanism configured to supply power from the engine to the input shaft of the supercharger, said drive mechanism including a driving member fixed to the shaft and a driven member fixed to the input shaft, with the members being drivingly interconnected, said driving member being sectioned into a plurality of segments that are interconnected and fixed to the shaft, such that the driving member can be fixed to the shaft without having to remove the shaft.

85. The personal watercraft as claimed in claim 78;

a water jet pump adjacent the stem of the body; and a driveline drivingly connecting the jet pump to the engine, with the driveline including a rotatable shaft, said compressor comprising a supercharger including a rotatable input shaft, said induction system including a drive mechanism configured to supply power from the engine to the input shaft of the supercharger, said drive mechanism including a driving pulley fixed to the shaft, a driven pulley fixed to the input shaft, and an endless belt entraining the pulleys, at least one of said pulleys presenting a belt-engaging surface and a recessed fluid flow passageway extending inwardly from the belt-engaging surface to relieve hydrodynamic forces between said at least one of the pulleys and the belt.

86. The personal watercraft as claimed in claim 78, said frame including a body-engaging plate that extends alongside the body and is secured thereto, said support structure including a pad of high-friction material between the plate and body for frictionally enhancing the connection between the plate and body.

87. The personal watercraft as claimed in claim 78;

a water jet pump adjacent the stem of the body; and a driveline drivingly connecting the jet pump to the engine, with the driveline including a rotatable shaft, said compressor comprising a supercharger including a rotatable input shaft, said induction system including a drive mechanism configured to supply power from the engine to the input shaft of the supercharger, said drive mechanism including a driving member fixed to the shaft, a driven member fixed to the input shaft, at least one rotatable idler member, and an endless element entraining the members, said endless element presenting opposite member engaging surfaces, an outer one of which engages the driving member and an inner one of which engages the idler member.

* * * * *